US011319142B2

(12) United States Patent
Crossett et al.

(10) Patent No.: US 11,319,142 B2
(45) Date of Patent: May 3, 2022

(54) CABLE CARRYING CASE

(71) Applicant: PPC BROADBAND INC., East Syracuse, NY (US)

(72) Inventors: Carl Crossett, Elmira, NY (US); Cary Lynne Mullin, Central Square, NY (US); Jacqueline Busco, Baldwinsville, NY (US); Brian Keith Hanson, Cicero, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 350 days.

(21) Appl. No.: 16/012,654

(22) Filed: Jun. 19, 2018

(65) Prior Publication Data

US 2018/0297773 A1 Oct. 18, 2018

Related U.S. Application Data

(63) Continuation of application No. 14/591,367, filed on Jan. 7, 2015, now abandoned, which is a continuation of application No. 13/022,261, filed on Feb. 7, 2011, now abandoned.

(60) Provisional application No. 61/394,649, filed on Oct. 19, 2010.

(51) Int. Cl.

| | |
|---|---|
| ***B65D 85/04*** | (2006.01) |
| ***B65H 49/32*** | (2006.01) |
| ***B65H 75/28*** | (2006.01) |
| ***B65H 49/20*** | (2006.01) |

(52) U.S. Cl.

CPC ..... *B65D 85/04* (2013.01); *B65H 49/205* (2013.01); *B65H 49/322* (2013.01); *B65H 75/285* (2013.01)

(58) Field of Classification Search

CPC .. B65H 37/005; B65H 49/205; B65H 49/322; B65H 75/285; B65H 75/406; B65H 2402/41; B65H 85/04; B65H 75/28

USPC .... 242/588, 588.1, 588.3, 588.6, 405, 405.3

See application file for complete search history.

(56) References Cited

U.S. PATENT DOCUMENTS

| | | | | |
|---|---|---|---|---|
| 1,094,542 | A * | 4/1914 | Dodge | B65H 35/0026 242/588.6 |
| 1,990,135 | A | 2/1935 | Sato | |
| 2,280,728 | A | 4/1942 | Albrecht | |
| D148,897 | S | 3/1948 | Ward | |
| 2,757,351 | A | 7/1956 | Klostermann | |
| D181,302 | S | 10/1957 | Oxley | |
| 2,841,343 | A | 7/1958 | Dorman | |

(Continued)

FOREIGN PATENT DOCUMENTS

| | | | |
|---|---|---|---|
| EP | 0542102 | A1 | 5/1993 |
| WO | 9014697 | A1 | 11/1990 |

(Continued)

*Primary Examiner* — Michael R Mansen
*Assistant Examiner* — Juan J Campos, Jr.
(74) *Attorney, Agent, or Firm* — MH2 Technology Law Group LLP

(57) ABSTRACT

A cable carrying case, in one embodiment, includes a first halve and a second halve that are coupled together by a fastener. The first and second halves pivot between an open and a closed position around the fastener. The cable carrying case has a releasable support member that is configured to support the weight of a spool of cable. The spool of cable may rotate about the support member to dispense the cable from within the case through a slot.

16 Claims, 15 Drawing Sheets

(56) References Cited

U.S. PATENT DOCUMENTS 2,858,358 A 10/1958 Montena
2,965,331 A 12/1960 Nagy
3,129,348 A 4/1964 Simmons
3,184,706 A 5/1965 Atkins
3,199,061 A 8/1965 Johnson et al.
3,292,136 A 12/1966 Somerset
3,332,052 A 7/1967 Rusinyak
3,373,243 A 3/1968 Janowiak
3,375,485 A 3/1968 Donohue et al.
3,378,215 A * 4/1968 Wilson ..... B65H 75/16 242/171
3,448,430 A 6/1969 Kelly
3,498,647 A 3/1970 Schroder
3,512,224 A 5/1970 Siebelist
3,522,576 A 8/1970 Cairns
3,537,065 A 10/1970 Winston
3,609,637 A 9/1971 Cole
3,665,371 A 5/1972 Cripps
3,668,612 A 6/1972 Nepovim
3,671,926 A 6/1972 Nepovim
3,678,445 A 7/1972 Brancaleone
3,678,446 A 7/1972 Siebelist
3,681,739 A 8/1972 Kornick
3,686,623 A 8/1972 Nijman
3,710,005 A 1/1973 French
3,739,076 A 6/1973 Schwartz
3,740,453 A 6/1973 Callaghan et al.
3,835,442 A 9/1974 Anderson et al.
3,835,443 A 9/1974 Arnold et al.
3,846,738 A 11/1974 Nepovim
3,879,102 A 4/1975 Horak
3,976,352 A 8/1976 Spinner
D241,341 S 9/1976 Oxley
3,985,418 A 10/1976 Spinner
3,986,737 A 10/1976 Krusche
4,083,268 A 4/1978 Kober
4,106,839 A 8/1978 Cooper
4,128,293 A 12/1978 Paoli
4,179,030 A 12/1979 Hayes et al.
4,280,749 A 7/1981 Hemmer
4,329,540 A 5/1982 Howarth
4,330,166 A 5/1982 Cooper et al.
4,423,919 A 1/1984 Hillis
4,426,127 A 1/1984 Kubota
4,525,000 A 6/1985 Bachle
4,531,805 A 7/1985 Werth
4,583,811 A 4/1986 McMills
4,593,964 A 6/1986 Forney, Jr. et al.
4,630,806 A 12/1986 Dan et al.
4,648,684 A 3/1987 Mattis et al.
4,684,201 A 8/1987 Hutter
4,698,028 A 10/1987 Caro et al.
4,703,988 A 11/1987 Raux et al.
4,746,305 A 5/1988 Nomura
RE32,787 E 11/1988 Gallusser et al.
4,808,128 A 2/1989 Werth
4,813,716 A 3/1989 Lalikos et al.
4,834,675 A 5/1989 Samchisen
4,936,788 A 6/1990 Lin
4,952,174 A 8/1990 Sucht et al.
D313,222 S 12/1990 Takizawa
4,979,911 A 12/1990 Spencer
4,984,685 A 1/1991 Douglas
4,990,106 A 2/1991 Szegda
5,002,503 A 3/1991 Campbell et al.
5,011,422 A 4/1991 Yeh
5,024,606 A 6/1991 Ming-Hwa
5,029,704 A 7/1991 Stillinger
5,043,696 A 8/1991 Wang
5,066,248 A 11/1991 Gaver, Jr. et al.
5,078,623 A 1/1992 Wang
5,083,943 A 1/1992 Tarrant
5,088,936 A 2/1992 Wang
5,112,250 A 5/1992 Wang
D327,872 S 7/1992 McMills et al.
5,139,210 A 8/1992 Schaffer
5,167,525 A 12/1992 Wang
5,167,536 A 12/1992 Wang
5,192,226 A 3/1993 Wang
5,219,299 A 6/1993 Wang
5,226,838 A 7/1993 Hsu
D339,568 S 9/1993 Salz
5,270,487 A 12/1993 Sawamura
5,321,207 A 6/1994 Huang
5,340,325 A 8/1994 Pai
5,342,096 A 8/1994 Bachle et al.
5,383,798 A 1/1995 Lin
5,387,116 A 2/1995 Wang
5,387,127 A 2/1995 Wang
5,389,012 A 2/1995 Huang
5,397,252 A 3/1995 Wang
5,413,502 A 5/1995 Wang
5,430,618 A 7/1995 Huang
5,438,251 A 8/1995 Chen et al.
5,470,257 A 11/1995 Szegda
5,478,258 A 12/1995 Wang
5,498,175 A 3/1996 Yeh et al.
5,599,198 A 2/1997 Wang
5,600,094 A 2/1997 McCabe
5,631,880 A 5/1997 Houlihan
5,632,651 A 5/1997 Szegda
5,667,409 A 9/1997 Wong et al.
5,669,571 A 9/1997 Graybill
5,683,263 A 11/1997 Hsu
5,687,928 A 11/1997 Lassiter
5,702,261 A 12/1997 Wang
5,722,856 A 3/1998 Fuchs et al.
5,723,818 A 3/1998 Yeh
5,730,621 A 3/1998 Wang
5,769,652 A 6/1998 Wider
5,775,621 A 7/1998 Sauber
5,803,757 A 9/1998 Wang
5,820,408 A 10/1998 Wang
5,832,651 A 11/1998 Arntz
5,863,226 A 1/1999 Lan
5,879,166 A 3/1999 Wang
5,913,487 A 6/1999 Leatherman
5,924,869 A 7/1999 Haas
5,934,137 A 8/1999 Tarpill
5,951,319 A 9/1999 Lin
5,957,730 A 9/1999 Wang
5,975,949 A 11/1999 Holliday et al.
5,975,951 A 11/1999 Burris et al.
5,980,308 A 11/1999 Hu et al.
5,997,350 A 12/1999 Burris et al.
6,024,588 A 2/2000 Hsu et al.
6,065,976 A 5/2000 Wang
6,095,869 A 8/2000 Wang
6,113,431 A 9/2000 Wong
6,139,344 A 10/2000 Wang et al.
6,145,780 A 11/2000 Fontana
6,146,197 A 11/2000 Holliday et al.
6,153,830 A 11/2000 Montena
6,159,046 A 12/2000 Wong
D436,076 S 1/2001 Montena
6,179,104 B1 1/2001 Steinmuller et al.
6,179,656 B1 1/2001 Wong
D437,826 S 2/2001 Montena
D440,539 S 4/2001 Montena
D440,939 S 4/2001 Montena
6,234,421 B1 5/2001 Cox et al.
6,234,838 B1 5/2001 Wong
6,276,970 B1 8/2001 Wong
6,287,148 B1 9/2001 Huang
6,332,815 B1 12/2001 Bruce
6,375,115 B1 4/2002 Reed
6,386,912 B1 5/2002 Li
6,390,840 B1 5/2002 Wang
D458,904 S 6/2002 Montena
6,402,155 B2 6/2002 Sakata
6,406,330 B2 6/2002 Bruce
D460,739 S 7/2002 Fox
D461,166 S 8/2002 Montena
D461,167 S 8/2002 Montena

(56) References Cited

U.S. PATENT DOCUMENTS

D461,778 S 8/2002 Fox
D462,058 S 8/2002 Montena
D462,060 S 8/2002 Fox
D462,327 S 9/2002 Montena
6,478,599 B1 11/2002 McHugh et al.
6,478,618 B2 11/2002 Wong
6,488,317 B1 12/2002 Daoud
6,491,163 B1 12/2002 Grcic et al.
D468,696 S 1/2003 Montena
6,523,777 B2 2/2003 Gaudio
6,530,807 B2 3/2003 Rodrigues et al.
6,558,194 B2 5/2003 Montena
D475,975 S 6/2003 Fox
D475,976 S 6/2003 Montena
D475,977 S 6/2003 Montena
6,634,906 B1 10/2003 Yeh
6,676,443 B1 1/2004 Wang
6,716,062 B1 4/2004 Palinkas et al.
6,733,336 B1 5/2004 Montena et al.
6,767,247 B2 7/2004 Rodrigues et al.
6,767,248 B1 7/2004 Hung
6,767,249 B1 7/2004 Li
6,769,926 B1 8/2004 Montena
6,776,650 B2 8/2004 Cheng et al.
6,776,657 B1 8/2004 Hung
6,776,665 B2 8/2004 Huang
6,780,052 B2 8/2004 Montena et al.
6,789,653 B1 9/2004 Hsu et al.
6,793,526 B1 9/2004 Hsu et al.
6,799,995 B2 10/2004 Hsu et al.
6,805,584 B1 10/2004 Chen
6,817,897 B2 11/2004 Chee
6,830,479 B2 12/2004 Holliday
6,848,939 B2 2/2005 Stirling
6,848,940 B2 2/2005 Montena
6,860,751 B1 3/2005 Huang
6,866,148 B2 3/2005 You et al.
D503,685 S 4/2005 Montena
D504,113 S 4/2005 Montena
D504,114 S 4/2005 Montena
D504,202 S 4/2005 Montena
6,881,075 B2 4/2005 Huang et al.
6,884,113 B1 4/2005 Montena
D505,391 S 5/2005 Rodrigues et al.
6,887,090 B2 5/2005 Lin et al.
D506,446 S 6/2005 Montena
6,908,337 B1 6/2005 Li
6,910,919 B1 6/2005 Hung
D507,242 S 7/2005 Montena
6,929,501 B2 8/2005 Huang
6,929,507 B2 8/2005 Lin
6,935,874 B1 8/2005 Fang et al.
6,935,878 B2 8/2005 Hsu et al.
6,948,969 B2 9/2005 Huang
6,948,973 B1 9/2005 Hsu et al.
6,951,469 B1 10/2005 Lin
6,956,464 B2 10/2005 Wang et al.
D511,497 S 11/2005 Murphy et al.
D511,498 S 11/2005 Holliday
D512,024 S 11/2005 Murphy et al.
6,966,791 B1 11/2005 Farr
D512,689 S 12/2005 Murphy et al.
D513,406 S 1/2006 Rodrigues et al.
D513,736 S 1/2006 Fox
D514,071 S 1/2006 Vahey
D515,037 S 2/2006 Fox
6,994,588 B2 2/2006 Montena
7,001,204 B1 2/2006 Lin
7,004,765 B2 2/2006 Hsu et al.
7,004,777 B2 2/2006 Lien et al.
7,008,263 B2 3/2006 Holland
7,018,235 B1 3/2006 Burris et al.
D518,772 S 4/2006 Fox
D519,076 S 4/2006 Fox
D519,451 S 4/2006 Fox
D519,453 S 4/2006 Rodrigues et al.
D519,463 S 4/2006 Tamezane
7,021,965 B1 4/2006 Montena et al.
7,032,854 B2 4/2006 Marsden
D521,454 S 5/2006 Murphy et al.
D521,930 S 5/2006 Fox
7,063,551 B1 6/2006 Lin
7,114,990 B2 10/2006 Bence et al.
7,118,416 B2 10/2006 Montena et al.
7,128,603 B2 10/2006 Burris et al.
D535,259 S 1/2007 Rodrigues et al.
7,182,639 B2 2/2007 Burris
7,188,416 B1 3/2007 Woehlke et al.
7,192,308 B2 3/2007 Rodrigues et al.
D543,948 S 6/2007 Montena
D544,837 S 6/2007 Disbennett et al.
7,241,172 B2 7/2007 Rodrigues et al.
7,252,546 B1 8/2007 Holland
7,255,598 B2 8/2007 Montena et al.
7,288,002 B2 10/2007 Rodrigues et al.
7,303,436 B1 12/2007 Li
7,320,445 B2 1/2008 Eastwood et al.
7,354,462 B2 4/2008 O'Rear
7,364,462 B2 4/2008 Holland
7,371,113 B2 5/2008 Burris et al.
7,479,035 B2 1/2009 Bence et al.
7,507,117 B2 3/2009 Amidon
7,513,795 B1 4/2009 Shaw
D601,966 S 10/2009 Shaw
D601,967 S 10/2009 Shaw
D607,826 S 1/2010 Shaw
D607,827 S 1/2010 Shaw
D607,828 S 1/2010 Shaw
D607,829 S 1/2010 Shaw
D607,830 S 1/2010 Shaw
D608,294 S 1/2010 Shaw
7,753,705 B2 7/2010 Montena
7,824,216 B2 11/2010 Purdy
7,841,595 B2 11/2010 Massoud et al.
7,845,976 B2 12/2010 Mathews
7,892,005 B2 2/2011 Haube
7,892,024 B1 2/2011 Chen
7,931,509 B2 4/2011 Shaw et al.
7,955,126 B2 6/2011 Bence et al.
8,016,222 B2 9/2011 Galgano et al.
8,251,212 B2 8/2012 Dunlap
2002/0125161 A1 9/2002 Cote
2002/0146935 A1 10/2002 Wong
2003/0092319 A1 5/2003 Hung
2003/0194902 A1 10/2003 Huang
2003/0236027 A1 12/2003 Wang
2004/0053533 A1 3/2004 Huang
2004/0067688 A1 4/2004 Cheng et al.
2004/0077215 A1 4/2004 Palinkas et al.
2004/0102095 A1 5/2004 Huang
2004/0124305 A1 7/2004 Huang
2004/0147164 A1 7/2004 Li
2004/0149798 A1 8/2004 Hoffman et al.
2004/0171297 A1 9/2004 Hsu et al.
2004/0171315 A1 9/2004 Liao et al.
2004/0224556 A1 11/2004 Qin et al.
2005/0009379 A1 1/2005 Huang et al.
2005/0020121 A1 1/2005 Lin et al.
2005/0032410 A1 2/2005 Huang
2005/0070145 A1 3/2005 Huang
2005/0075012 A1 4/2005 Hsu et al.
2005/0153587 A1 7/2005 Hsu et al.
2005/0159030 A1 7/2005 Hsu
2005/0186852 A1 8/2005 Hsu et al.
2005/0186853 A1 8/2005 Hsu et al.
2005/0202690 A1 9/2005 Lien et al.
2005/0202699 A1 9/2005 Fang et al.
2005/0233632 A1 10/2005 Hsu et al.
2005/0250357 A1 11/2005 Chen et al.
2005/0260894 A1 11/2005 Chen et al.
2006/0094300 A1 5/2006 Hsu et al.
2006/0110977 A1 5/2006 Matthews
2006/0121753 A1 6/2006 Chiang et al.
2006/0121763 A1 6/2006 Chiang et al.

(56) References Cited

U.S. PATENT DOCUMENTS

| | | | | |
|---|---|---|---|---|
| 2006/0175461 | A1 | 8/2006 | Williamson | |
| 2006/0292926 | A1 | 12/2006 | Chee et al. | |
| 2007/0210131 | A1* | 9/2007 | Yarborough | B65H 75/32 225/56 |
| 2008/0156916 | A1 | 7/2008 | DeLuca et al. | |
| 2009/0098770 | A1 | 4/2009 | Bence et al. | |
| 2009/0194630 | A1 | 8/2009 | Thiyagarajan | |
| 2009/0277988 | A1* | 11/2009 | Hernik | B65H 75/4481 242/478.2 |
| 2010/0096485 | A1* | 4/2010 | Taatjes | B33Y 40/00 242/171 |
| 2010/0163667 | A1 | 7/2010 | Dorais et al. | |
| 2011/0021072 | A1 | 1/2011 | Purdy | |

FOREIGN PATENT DOCUMENTS

| | | | |
|---|---|---|---|
| WO | 1999065116 | A1 | 12/1999 |
| WO | 1999065117 | A1 | 12/1999 |
| WO | 2003096484 | A1 | 11/2003 |
| WO | 2005083845 | A1 | 9/2005 |

* cited by examiner

CABLE CARRYING CASE

CROSS REFERENCE TO RELATED APPLICATIONS

This is a continuation of U.S. application Ser. No. 14/591,367, filed Jan. 7, 2015, which is a continuation of U.S. application Ser. No. 13/022,261, filed Feb. 7, 2011, which is a non-provisional of, and claims the benefit and priority of U.S. Provisional Patent Application No. 61/394,649, filed on Oct. 19, 2010. The entire contents of such applications are hereby incorporated by reference.

BACKGROUND

1. Technical Field

This invention relates generally to cable, and in particular to a packaging and carrying case for packaging, carrying and dispensing cable.

2. State of the Art

In today's digital world, cables are commonly employed to carry signals from location to location and between various electronic devices. For example, coaxial cables, fiber optic cables, and other multi-conductor cables are widely used to carry high-frequency electrical signals from one location to another.

A coaxial cable, in particular, typically comprises an elongate inner conductor, a tubular outer conductor, and a dielectric separating the inner and outer conductors. An outer insulating jacket may also be applied to surround the outer conductor. Given the size of these cables and the materials from which they are usually constructed, these cables normally cannot be tightly coiled without kinking. Thus, to protect these cables, they are packaged in pre-fabricated cardboard boxes or wrapped around rigid spools or reels.

Cable installers are frequently called upon to install cable at different locations for various reasons. For example, a cable installer may be asked to connect a new internet or cable-TV customer to a trunk cable or pedestal from which a signal flows. To accomplish this, the installer typically carries one or more of relatively large boxes containing cable, reels of cable, or reels of cable within in a case to the installation site to connect the customer to the trunk cable. The installer manually dispenses the cable from the larger supply, measures and cuts the desired length of cable, installs respective connectors onto the ends of the cable, and uses this prepared cable to connect the customer's interface to the pedestal or trunk cable.

However, the process of carrying and dispensing the desired length of cable from the larger supply, either from the large box or the case, at the installation site can be a burdensome and/or wasteful endeavor. For example, when dispensed from many of the large boxes, as well as the cases, the cables tend to kink and become damaged. Further, these large boxes are not reusable and installers generally have a difficult time transporting these large boxes from place to place at the installation site. In addition, these boxes and cases are also not sufficiently strong to prevent the cable therein from being damaged in the ordinary course of business, such as when the box falls, is crushed by other boxes, or gets tossed around and banged up. Once kinked or damaged, the cable is defective and can no longer be used, resulting in excessive waste. Moreover, many of the boxes and cases, including their inner contents, are not made from recyclable material and thus cannot be recycled.

Thus, there is a need within the cable industry for a cable carrying case that addresses the concerns outlined above. Specifically, there is a need for a cable carrying case that is re-usable, recyclable, protects the cable from damage, and is easy to use by the installers.

SUMMARY

The present invention relates to cable, and in particular to a packaging and carrying case for packaging, carrying and dispensing cable.

One aspect disclosed herein is a case that holds cable spools, the case having two halves, a first half and a second half that are coupled together at a first fastener on a first side of the case and a second fastener on a second side of the case, the first and second halves being movable between an open position and a closed position by releasing or securing the fasteners, respectively.

Another aspect disclosed herein includes the case further comprising a cylindrical protrusion. In the open position, the center hole of a spool/reel of cable can be slid onto the cylindrical protrusion that is releasably attached to the inner surface of either the first or second half at a receiving port on the inside surface of the first half and the second half. When the cylindrical protrusion is attached to the first half at the receiving port, the exposed end of the cylindrical protrusion is attached to the receiving port of the second half upon the case being closed, and vice versa. The cylindrical protrusion further comprises exposed ends, the exposed ends of the cylindrical protrusion having a smaller diameter than the remaining diameter of the main body of the cylindrical protrusion. Also, in the closed position, the cylindrical protrusion can support the weight of the spool of cable that has been placed thereon. This is due to the smaller diameter of the exposed ends being secured to, and supported within, the circular receiving ports, which thus fixes (or stabilizes) the cylindrical protrusion within the case. In this configuration, the spool may also rotate about the cylindrical protrusion in response to the cable being pulled from the case.

Another aspect disclosed herein includes the case being repeatedly used. Because the case can move between the opened and closed position, it is reusable, in that once a spool of cable is used up, the case can be opened and a new spool of cable can be inserted in its place. The case is thereafter closed and can be carried or moved to where it is needed next.

Another aspect disclosed herein includes the ease of use of the case. For example, to remove the cable from the case, the case has an opening on each side of the case under the first and second fasteners respectively. The opening is such that the end of the cable can be inserted through the opening and conveniently pulled off the spool, as needed. This particular configuration allows the cable to not tangle on itself or kink as it is being released from the spool. Also, although not necessarily pictured, the case may also have a securing mechanism that secures the free end of the cable to the case during storage of the case or when the cable is not being pulled off the spool.

Another aspect disclosed herein includes the case being made of a rigid, recyclable material. In this rigid, durable configuration the case suitably protects its inner contents (i.e., the frame of the spool and the cable itself).

Another aspect disclosed herein includes the case further comprising connection ports positioned on the top of the case for connecting and supporting a shoulder strap.

The foregoing and other features and advantages disclosed herein will be apparent from the following more detailed description of the particular embodiments of the invention, as illustrated in the accompanying drawings.

DETAILED DESCRIPTION OF EMBODIMENTS

As discussed above, embodiments of the present invention relate to cable carrying cases, and in particular to a reusable carrying case for carrying and dispensing cable from a spool or reel.

Figure 1:
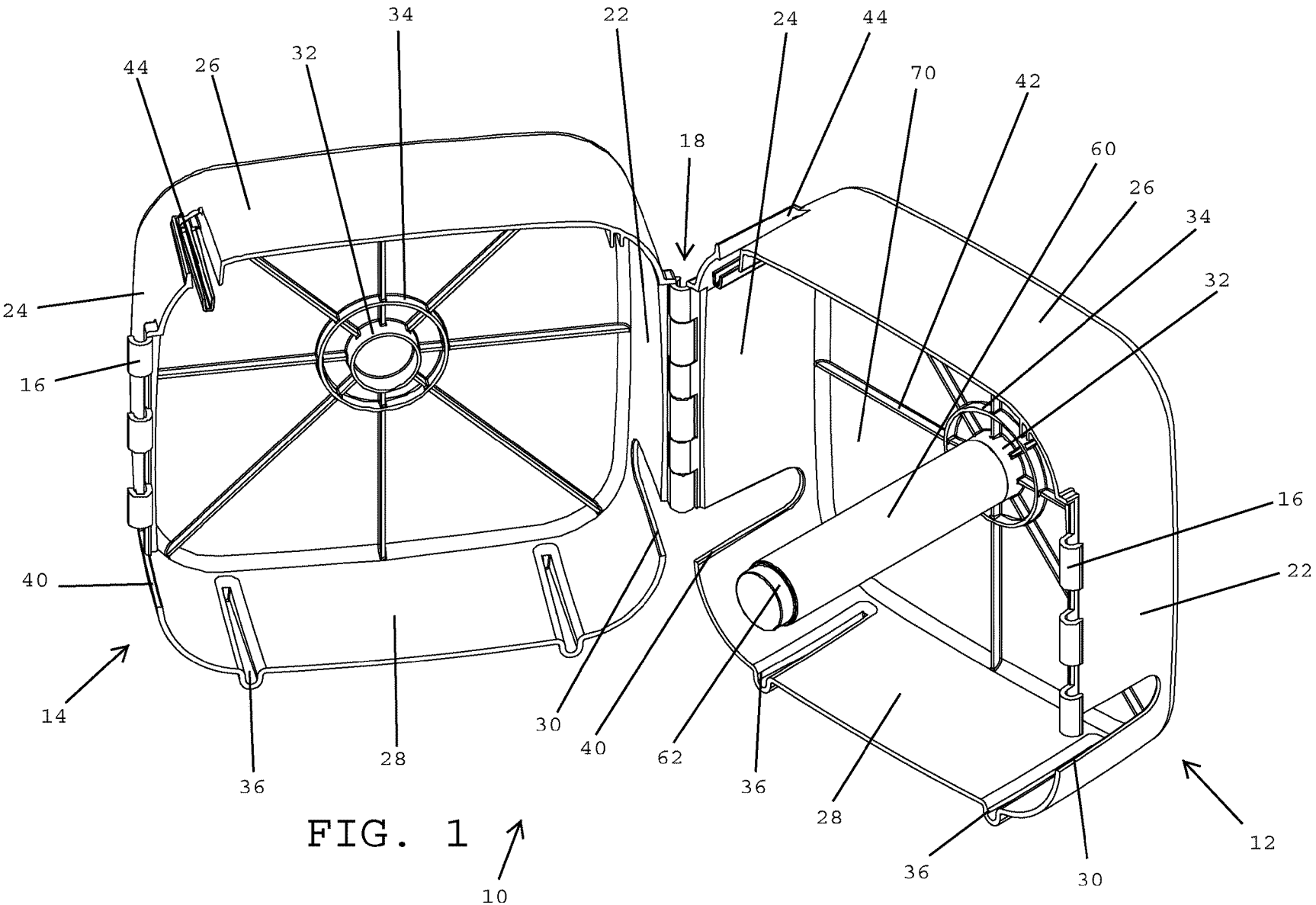
FIG. 1 is a front perspective view of an embodiment of a cable carrying case in an open position.
Figure 3:
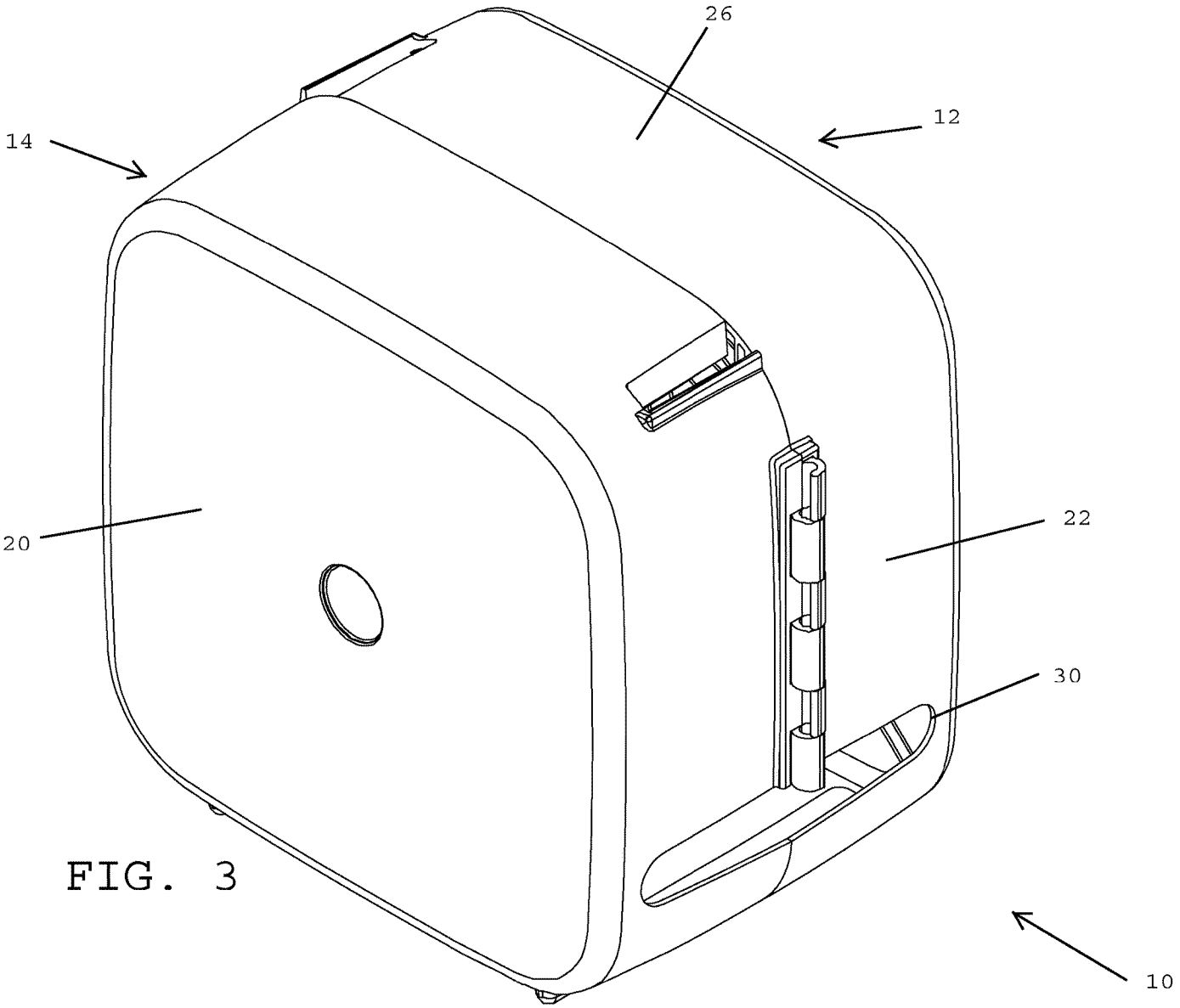
FIG. 3 is another front perspective view of an embodiment of the cable carrying case in a closed position.

As shown in FIG. 1, the case 10 comprises a first body portion 12 and a second body portion 14. As pertaining to some embodiments of the case 10, the first body portion 12 and the second body portion 14 can be sized and configured so as to be two separate halves 12 and 14 of the case 10. With respect to the embodiment depicted in FIG. 1, the first body portion or half 12 and the second body portion or half 14 can be coupled together at a hinge 18 on the case 10 and can pivot between an open position, as shown in FIG. 1, and a closed position, as shown in FIG. 3, around the hinge 18. The hinge 18 can be a combination of fasteners 16 on respective first and second halves 12 and 14 that couple together to form the hinge 18. In this configuration, the first and second halves 12 and 14, respectively, can pivot about the hinge 18 formed on the rear of half 12 and on the front of half 14 and can be locked in the closed position or released to the open position, as the case may be, by the fastener 16 positioned on the front side of the case 10. In the alternative, the first half 12 and the second half 14 can be coupled together at the hinge 18 formed on the front of half 12 and the rear of half 14, not shown, such that the first and second halves 12 and 14 can be locked in the closed position or released to the open position, as the case may be, by the fasteners 16 positioned on the back side of the case 10. The particular configuration of the case 10, described above, can be chosen by the user. Thus, the user can choose to have the case 10 pivot about either the fastener 16 positioned on the front of the case 10 or the fastener 16 positioned on the rear of the case 10, as desired. As shown in FIG. 1, the fastener 16 on the front of the second half 14 couples with the fastener 16 on the rear of the first half 12 to form the hinge 18. In yet other embodiments, the halves 12 and 14 of the case 10 do not pivot about the hinge 18 to move from the closed position to the open position, or vice versa, but are merely separable from one another after the fasteners 16 have been released.

Each of the first and second halves 12 and 14, respectively, is configured in a square-shaped dome that has a surface 20, best seen in FIG. 3, and secondary surfaces, 22, 24, 26, and 28, as seen in FIG. 1, that extend from the surface 20. The surface 20 is square-like in shape and the secondary surfaces 22, 24, 26 and 28 protrude from the surface 20, such that the surface 20 and the secondary surfaces 22, 24, 26 and 28 structurally define the square-shaped, domed configuration. Such a configuration allows the two halves 12 and 14 to be placed together in the closed position to define a cube-like shape having a hollow, vacant interior space in which a spool 50 of cable 52 may be housed and carried. Thereafter, a user may use the case 10 to payout the cable 52 as needed to perform a task, as will be described in detail below.

With reference particularly to the first half 12, shown in FIG. 1, first half 12 further comprises a first opening 30, a receiving port 32, anti-friction member 34, feet 36, support member 60, second opening 40, and reinforcing members 42.

The first opening 30 is a horizontal, u-shaped opening defined by the secondary surface 22. In the embodiment shown in FIG. 1, the first opening 30 is almost as long as the secondary surface 22 is wide. Moreover, it is beneficial that the first opening 30 be open to the secondary surface 22 and not be completely bounded by the secondary surface 22. Such a configuration allows the first opening 30 to mate with a second opening 40 under the condition that the case 10 is placed in the closed position, which will be described in greater detail below.

Figure 2:
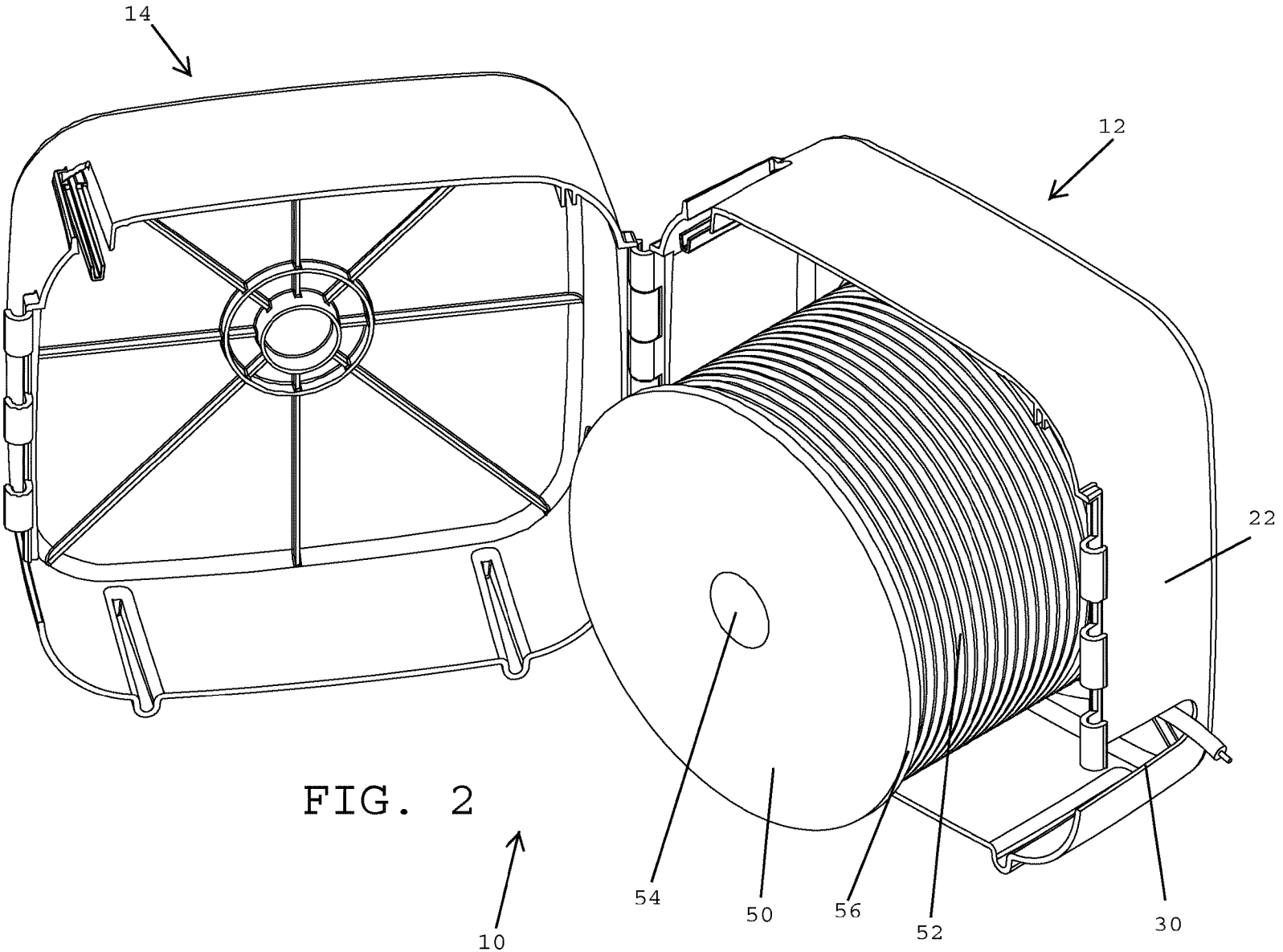
FIG. 2 is a front perspective view of an embodiment of the cable carrying case in an open position.

The particular positioning of the first opening 30 is important because it facilitates the payout of the cable 52 from the cable spool 50 and prevents the cable 52 from being damaged. The first opening 30 is positioned on the lower portion of the secondary surface 22 and corresponds with the payout position of the cable 52 on the spool 50 that is housed within the case 10. In this configuration, the cable 52 can be paid out from the case 10 at the proper angle to avoid kinking the cable 52. Also, the shape and size of the first opening 30 functions to hold the cable 52 in place when not in use, as shown in FIG. 2. The first opening 30 is small enough to keep the cable 52 from paying off the spool 50 when not in use. The first opening 30 thus serves a dual function—to not only allow easy payout of the cable 52 when needed but yet also allow the cable 52 to remain in place on the spool 50 when not needed. In alternative embodiments, the specific length and shape of the first opening 30 can be altered if the altered length and shape do not prohibit the function of the opening 30, as described above.

Similarly to the first opening 30, the second opening 40 is a horizontal, u-shaped opening located on the secondary surface 24 of the first half 12 and near the secondary surface 28. In the embodiment shown in FIG. 1, the second opening 40 is almost as long as the secondary surface 24 is wide. Moreover, it is beneficial that the second opening 40 be open to the secondary surface 24 and not be completely bounded by the secondary surface 24, such that the second opening 40 can mate with the first opening 30 under the condition that the case 10 is in the closed position, as mentioned above.

The particular positioning of the second opening 40 is important because, like the first opening 30, it facilitates the payout of the cable 52 from the cable spool 50 and prevents the cable 52 from binding, or from being damaged and kinked as it is paid out off the spool 50. To avoid the cable 52 from binding during payout and to avoid kinking the cable 52, the second opening 40 is positioned on the lower portion of the secondary surface 24 to correspond to the lower end of the spool 50. Also, the positioning of the second opening 40 in the secondary surface 24 corresponds to the positioning of the first opening 30 in the secondary surface 22. Having the opening 30 in the front of the case 10 and the opening 40 in the rear of the case 10 allows the spool of cable 50 to be placed within the case 10 in either a left-side payout configuration or a right-side payout configuration. As a result, installers that are either left-hand dominant or right-hand dominant can dispense the cable 52 in the appropriate and most convenient, easy-to-use manner.

The receiving port 32 is positioned on an interior face 70 of the surface 20. The receiving port 32 is positioned in a centralized portion of the interior face 70 and extends substantially orthogonally from the interior face 70. As shown, the receiving port 32 is a circular-shaped port, but may assume any shape that allows the receiving port 32 to receive the axial opening 54 of the spool 50. The receiving port 32 is also positioned on the second half 14 in much the same way as the receiving port 32 is positioned on the first half 12, as shown in FIG. 2. The receiving ports 32 function to support the spool 50 that is placed within the case 10. The axial opening 54 on each side of the spool 50 is received by the respective receiving ports 32 on the first and second halves 12 and 14. In this way, once the case 10 is pivoted to the closed position, the spool 50 is supported by each of the receiving ports 32 and is thus able to rotate thereabout in response to the cable 52 being paid out off the spool 50.

In addition to the function described above with respect to the receiving ports 32, the receiving ports 32 are also structurally configured to receive the support member 60. The support member 60, as shown, is a cylindrical-shaped protrusion or rod. However, the support member 60 may assume any other shape that allows the support member 60 to adequately support the weight of the spool of cable 50 placed thereon and allow the spool of cable 50 to rotate thereabout as cable 52 is paid out. The axial opening 54 of the spool of cable 50 is slid onto and over the support member 60.

Of course, if the support member 60 is used in conjunction with the receiving ports 32, the shape of the receiving ports 32 and the shape of the support member 60 must coincide to allow the support member 60 to be placed within the receiving port 32 and be supported thereby. To do so, the support member 60 has outer ends 62 on each of its ends. The outer ends 62 have an axial width substantially equal to the depth of the receiving port 32, and the outer ends 62 also have a diameter less than the diameter of the support member 60. The outer diameter of the receiving port 32 is substantially the same as the outer diameter of the support member 60 and the inner diameter of the receiving port 32 is substantially the same as the diameter of the outer ends 62. Thus, the outer ends 62 of the support member 60 are able to slide into and be supported by the receiving port 32.

The dimensions of the first half 12 and the second half 14 correspond to the diameter of a standard reel of cable 50. This allows the case 10 to properly house the reel or spool 50 to protect the spool 50 from damage and to facilitate proper payout of the cable 52 from the spool 50. Specifically with reference to proper payout of the cable 52, to avoid the problem of backlash when the cable 52 is paid out from the case 10, the first half 12 and the second half 14 are configured to have suitable dimensions to allow the interior faces of the respective secondary surfaces 22, 24, 26, 28 to function as barriers to prohibit the cable 52 from unintentionally unraveling or unwinding from off the spool 50. In this way, the interior faces of the respective secondary surfaces 22, 24, 26, 28 restrict the cable 52 from jumping over the outer flanges 56 of the spool 50, which can lead to the cable 52 becoming kinked and/or jammed, either of which would prohibit the efficient payout of the cable 52 from the case 10. However, the configuration of the case 10 addresses these issues and reduces the possibility of the cable 52 jumping over the outer flanges 56.

The anti-friction member 34 and the reinforcing members 42 are each positioned on the interior face 70. The anti-friction member 34 is shown in FIG. 1 as a circular member having a larger diameter than the receiving port 32. The reinforcing members 42 are also positioned on the interior face 70 and run along the face 70 from secondary surfaces 22, 24, 26, and 28 to the receiving port 32 located in the center of the interior face 70. The anti-friction member 34 and the reinforcing members 42 extend substantially orthogonally from the interior face 70, and the anti-friction member 34 extends further from the face 70 than the receiving port 32 and the reinforcing members 42. In such a configuration, the spool 50 does not contact the interior face 70 as the spool rotates within the case 10, but only the anti-friction member 34, which reduces the amount of friction and allows the cable spool 50 to rotate easily and with little effort from the installer.

The reinforcing members 42 function to further strengthen the rigidity of the halves 12 and 14 to protect the spool 50 and cable 52 from damage which might otherwise result from impact, collision and exterior pressure on the case 10.

The feet 36 are positioned in the secondary surface 28 at a predetermined interval. The feet 36 allow the first half 12, and the case 10 when the first half 12 is fastened to the second half 14, to rest up off a horizontal surface but squarely on that surface. The feet 36 provide stability to the case 10 when the case 10 is placed upon the ground or other surface. As shown in FIG. 1, the feet 36 are integral to the first half 12. However, in additional embodiments, the feet 36 may be removable from the first half 12 or the feet 36 may even be adjustable when attached to the first half 12 to adjust the height of the first half 12 up off the surface upon which the first half 12, or the case 10 when the first half 12 is fastened to the second half 14, rests.

As shown in FIG. 1, the front fastener 16 and the rear fastener 16 can be coupled to form a hinge mechanism 18. In particular, the secondary surface 24 of the first half 12 functions as the leaf of the hinge and secondary surface 22 of the second half 14 functions as the opposing leaf of the hinge 18. When the first half 12 and the second half 14 are coupled together at the rear fasteners 16, the knuckles on the secondary surface 24 of the first half 12 and the knuckles on the secondary surface 22 of the second half 14 interact to form a butt hinge 18, or a piano hinge. A pin with a tip can then be inserted down through the respective knuckles to complete the hinge mechanism 18. Once complete, the rear fastener 16 functions like a butt hinge and the first half 12 and second half 14 can pivot between the open position and the closed position about the hinge 18.

The front fastener 16 functions in a like manner. Specifically, when the first half 12 and the second half 14 are coupled together at the front fastener 16, the secondary surface 22 of the first half 12 and the secondary surface 24 of the second half 14 function as respective leafs of a butt hinge and the knuckles on the secondary surface 22 of the first half 12 and the knuckles on the secondary surface 24 of the second half 14 interact to form the knuckles of the butt hinge. A pin with a tip can then be inserted down through the respective knuckles to complete the hinge mechanism. Once complete, the front fastener 16 functions similarly to a butt hinge and the first half 12 and second half 14 can pivot between the open position and the closed position about the front fastener 16.

Because the case 10 can move between the opened and closed positions, it is reusable, in that once the spool of cable 50 is used up, the case 10 can be opened and a new spool of cable 52 can be inserted in its place. The case 10 is thereafter closed and can be carried or moved to the location where it is needed next.

The first half 12 further comprises a shoulder strap fastener 44 positioned on the secondary surface 26 near the secondary surface 24. A shoulder strap, not shown, may be attached to the first half 12 by way of the shoulder strap fastener 44. Moreover, the second half 14 comprises a similar fastener. Accordingly, the shoulder strap, not shown, may be attached to the second half 12 by way of its corresponding shoulder strap fastener. In such a configuration, the shoulder strap facilitates the transportation of the case 10 by the installer.

In the embodiment shown in FIG. 1, the first and second halves, 12 and 14, can be identical copies of one another and can be manufactured from the same mold. Indeed, in this embodiment, the features described above with respect to the first half 12 are likewise applicable to the second half 14. Thus, when placed side-by-side, the two halves 12 and 14 look indistinguishable from one another at any angle. However, when placed face-to-face, the structural configuration of the identical halves allows the two independent halves 12 and 14 to form the case 10, as described above. As a result, each case 10 is comprised of two identical halves 12 and 14. For example, in the embodiment of FIG. 1, the first opening 30 is in the same position on the first half 12 as it is on the second half 14. The second opening 40 is in the same position on the first half 12 as it is on the second half 14. This configuration allows the u-shaped first opening 30 on the first half 12 to correspond to the u-shaped second opening 40 on the second half 14 when the two halves 12 and 14 are in the closed position to thus combine openings to create a larger opening for the cable 52 to pass therethrough. Likewise, the configuration allows the first opening 30 on the second half 14 to correspond to the second opening 40 on the first half 14 when the two halves 12 and 14 are in the closed position to thus combine to create a larger opening for the cable 52 to pass therethrough. Also, the feet 36 on the first half 12 and the second half 14 correspond to one another. As previously mentioned above, the knuckles of the respective front fastener 16 and rear fastener 16 correspond to one another to facilitate the hinge action. Further as an example, the shoulder strap fastener 44 is located in the same position on the first half 12 and the second half 14, but when the first half 12 and the second half 14 are positioned face-to-face to create the case 10, as shown in FIG. 3, the shoulder strap fastener 44 on the first half 12 is located in the rear of the case 10 whereas the shoulder strap fastener 44 on the second half 14 is located in the front of the case 10 to allow the shoulder strap to be fastened to both the front and rear of the case 10 to support both the front and the rear of the case 10.

Structuring the case 10 to be comprised of two identical, yet opposing halves, 12 and 14, provides several advantages over other cases. For example, if only one half, 12 or 14, of the case 10 is damaged, only that damaged half need be replaced by an identical replacement half. Thus, the entire case 10 does not need to be disposed of if only one half, 12 or 14, is damaged. This significantly reduces the replacement cost of the case 10. Further, manufacturing costs are reduced by half, because only one mold is needed to produce both halves 12 and 14 of the case 10.

Figure 4:
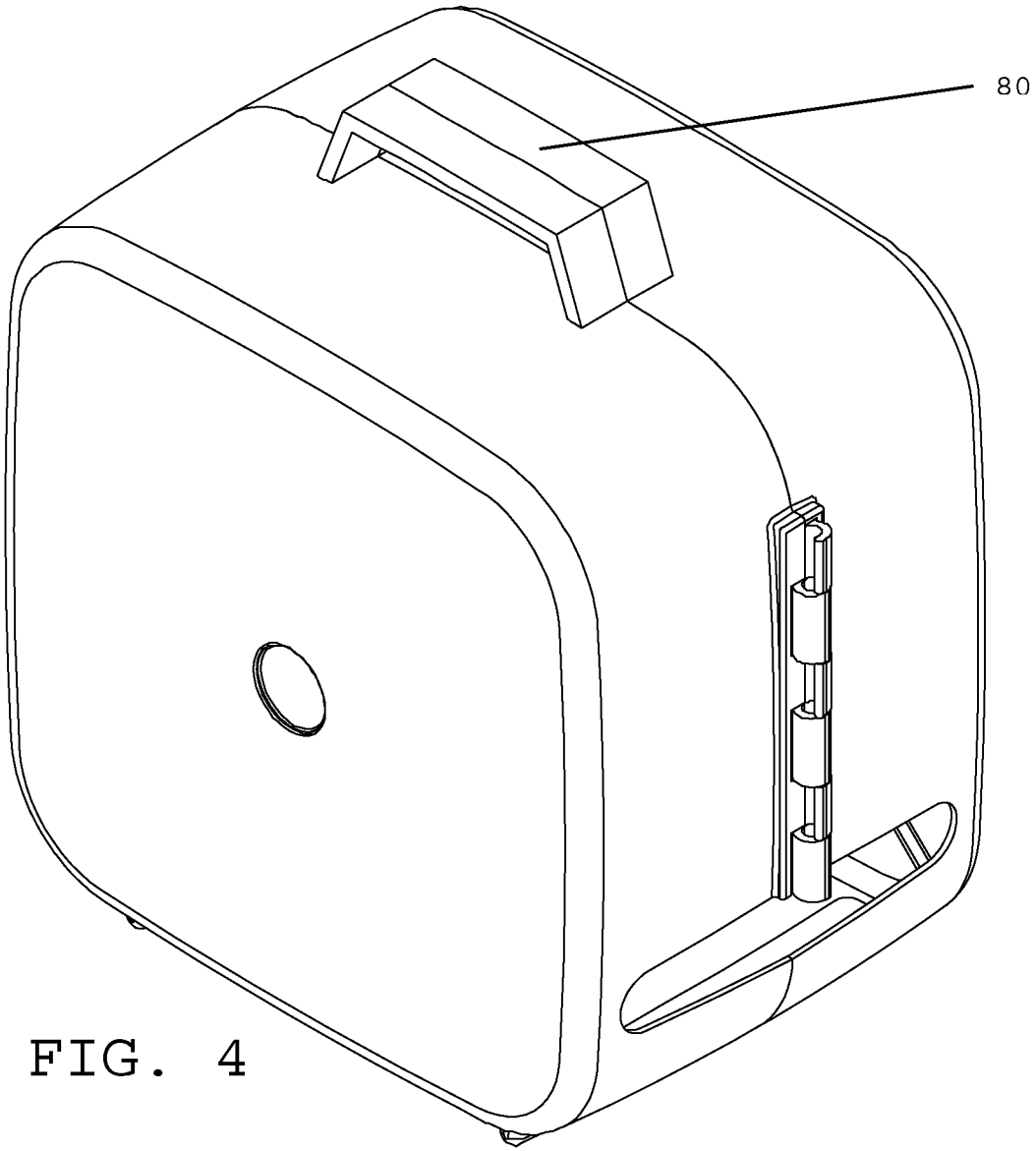
FIG. 4 is a front perspective view of an additional embodiment of a cable carrying case in a closed position.

In an alternative embodiment, the first half 12 and the second half 14 may further comprise a handle 80, as shown in FIG. 4. Each of the first half 12 and the second half 14 may comprise one half of the handle 80, such that when the first half 12 and the second half 14 are moved to the closed position, the complete handle 80 is formed. In yet another embodiment, either the first half 12 or the second half 14 may comprise the complete handle 80. Further yet, in another embodiment, the case 10 may include both the handle 80 and the shoulder strap fasteners 44 to attach a shoulder strap thereto.

Figure 5:
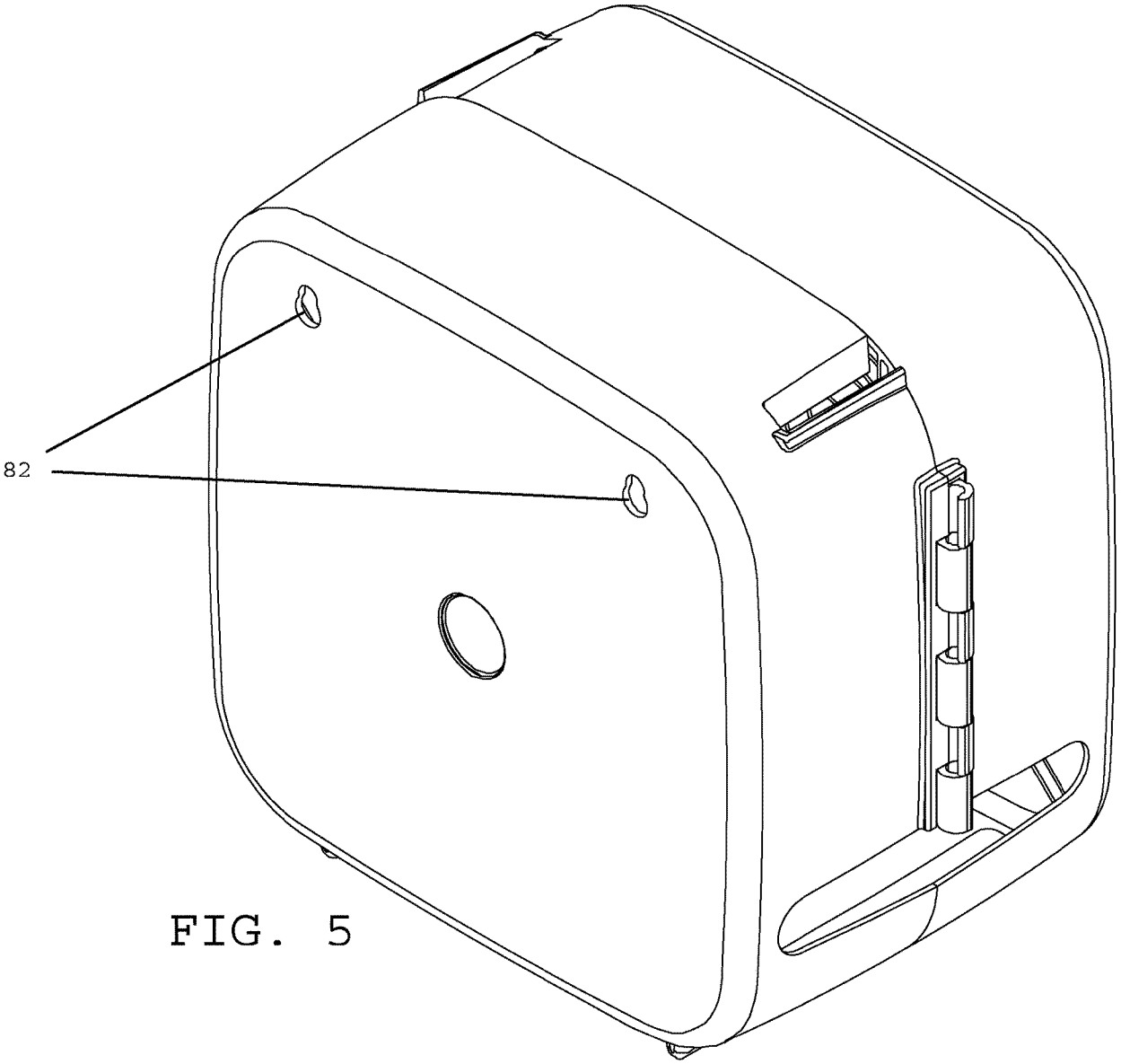
FIG. 5 is a front perspective view of a further embodiment of the cable carrying case in a closed position.

In another alternative embodiment, as shown in FIG. 5, the vertical surface 20 of may comprise mounting ports 82 thereon to facilitate the mounting of the case 10 to another surface. The mounting ports 82 being capable of receiving a plurality of protrusions on another surface and securing the case 10 to the another surface.

Figure 6:
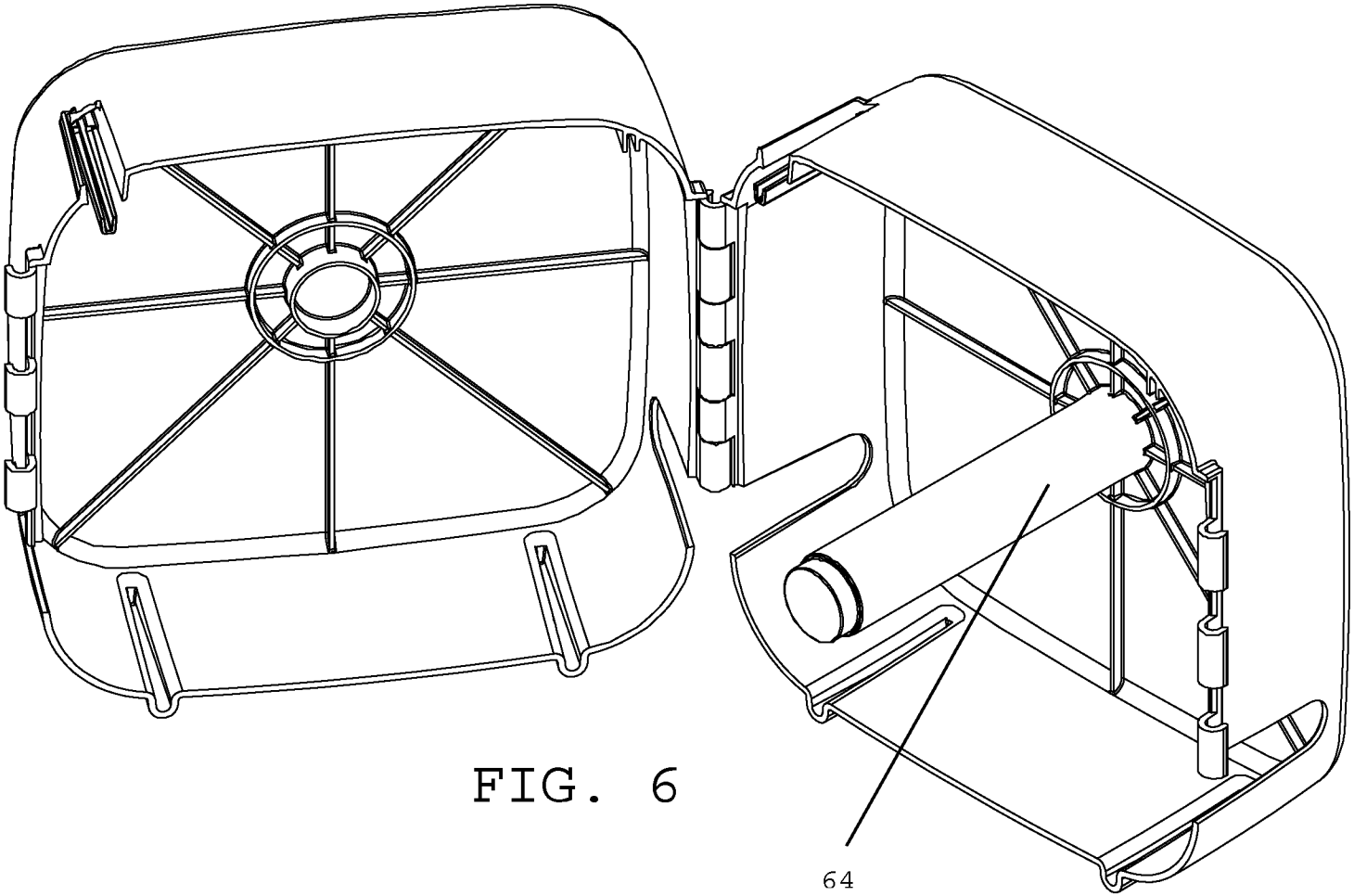
FIG. 6 is a front perspective view of an additional embodiment of the cable carrying case in an open position.
Figure 7:
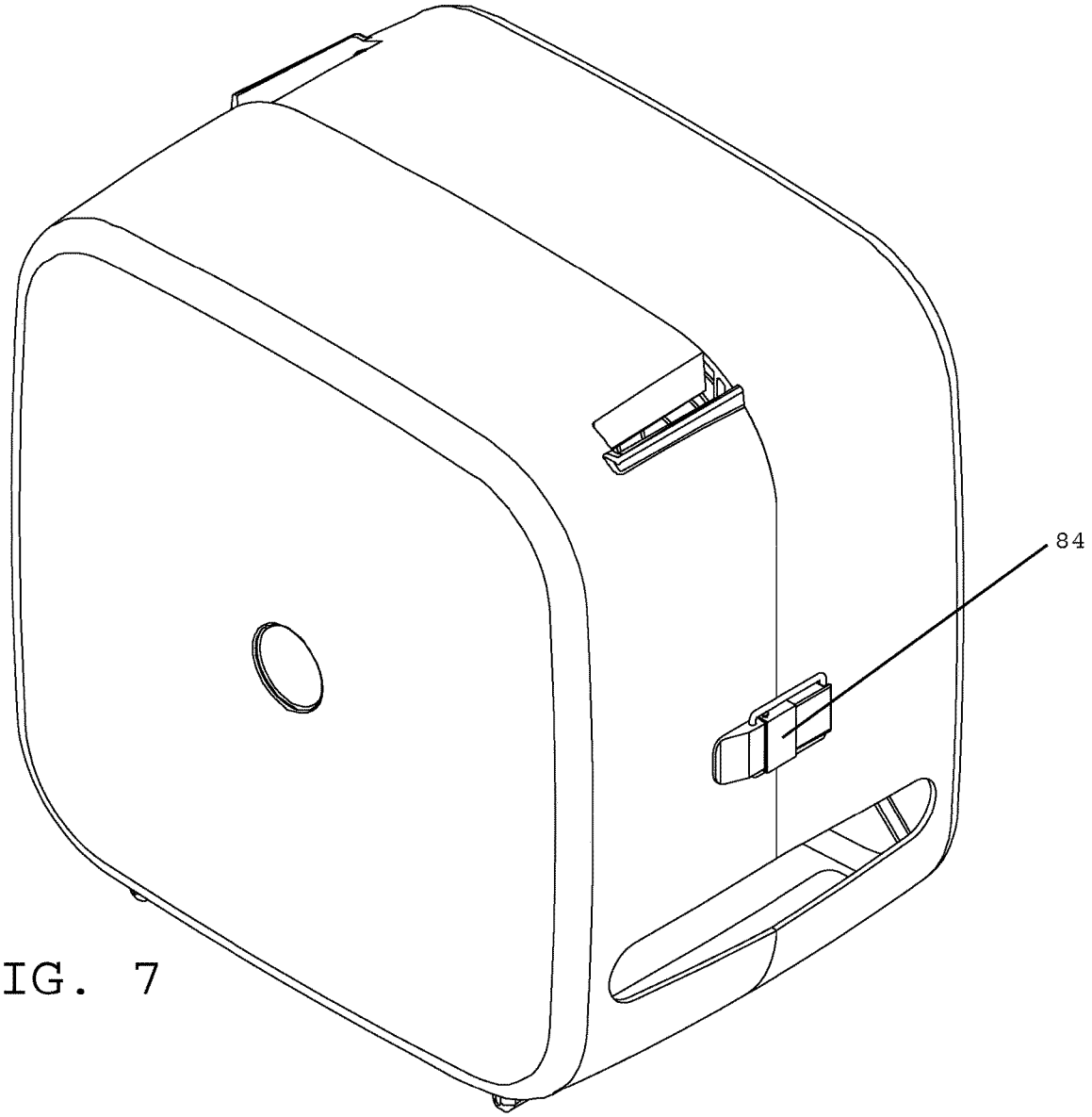
FIG. 7 is a front perspective view of still further embodiment of the cable carrying case in a closed position.

In another alternative embodiment, the first half 12 and the second half 14 of the case 10 may be structured to be different from one another. For example, as shown in FIG. 6, the support member 60 may be a permanent protrusion 64 from the interior face 70 of the first half 12, instead of being releasably attached, as described above. Specifically, the permanent protrusion 64 is integral to the first half 12 and is releasably coupled to the second half 14 at the receiving port 32 positioned on the interior face 70 of the second half 14 when the case 10 is closed. As another example, as shown in FIG. 7, the front fastener 16 may be a latch mechanism 84 to fasten the case 10 in the closed position while the rear fastener 18 is a hinge mechanism about which the first half 12 and the second half 14 pivot between the open and the closed positions.

Figure 8:
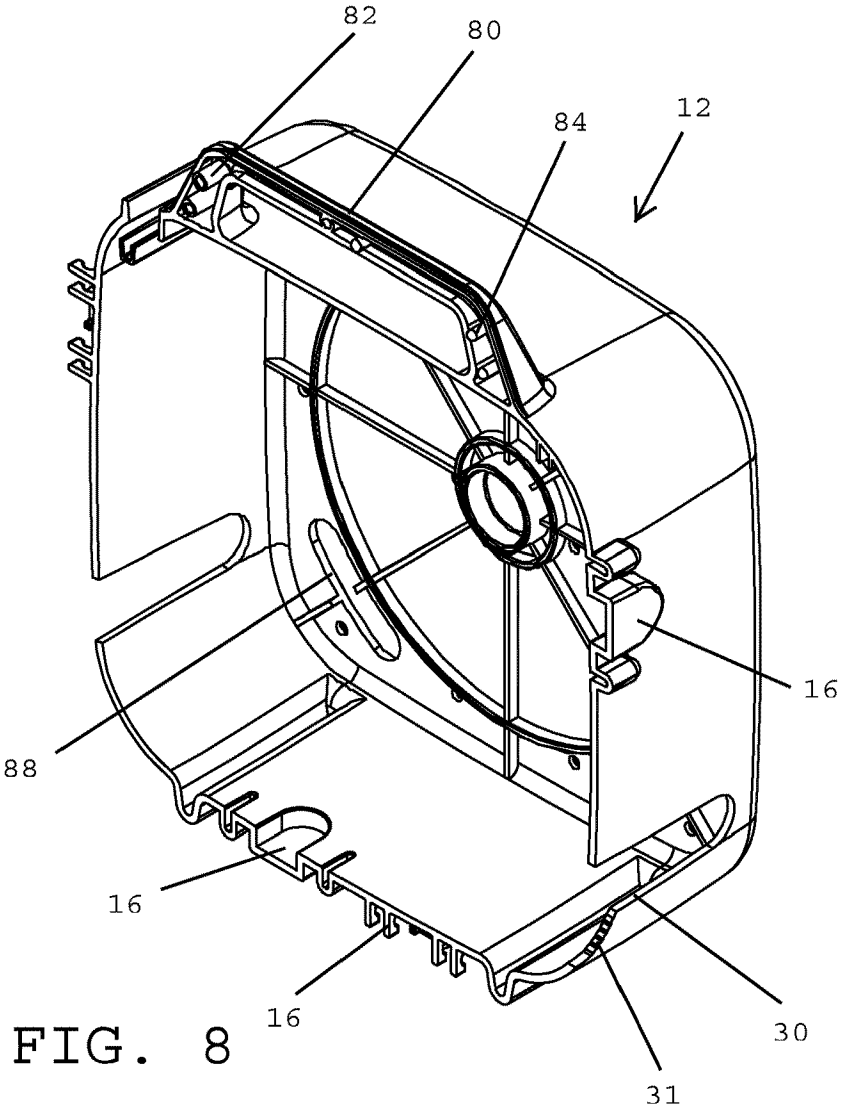
FIG. 8 is a front interior perspective view of a component of an embodiment of the cable carrying case.

As shown in FIG. 8, an alternative embodiment of the case 10 further comprises a cable securing section 31 that functions to fix the loose end of the cable 52 to the case 10 when the cable 52 is not being used or is being stored. Although the relatively small size and shape of the first opening 30 functions to prohibit the loose end of the cable 52 from unintentionally paying out from the spool 50 during use or even during non-use, the cable securing section 31 is smaller in size than the first opening 30 and assists the first opening 30 in securing the cable 52 to the case. Indeed, the cable securing section 31 is configured to be a notch, or other indentation, in the first opening 30 that is large enough at its initial point to receive the width of the cable 52 yet small enough at its end point to allow the cable securing section 31 to grip the width of the cable 52.

In some embodiments, the cable securing section 31 is an angled section having a v-like shape. The v-like shape can formed by placing a tapered end portion in the first opening 30 that functionally meets the second opening 40 under the condition that the case 10 is in the closed position. The resulting v-like shape allows the initial point of the cable securing section 31 to be wider than the width of the cable 52 and also to be small enough at its end point so that the cable securing section 31 can effectively grip and secure the cable 52 to the case 10. Moreover, to assist in the gripping of the cable 52, the cable securing section 31 can have an edge surface with raised portions thereon to effectively grip and retain the cable 52. The edge surface may be a ribbed edge, a toothed edge, or other like edge that functions to better grip the outer surfaces of the cable 52. Further, the edge surface may be covered or layered with a material to further assist the gripping and retention of the cable 52. For example, the edge surface may have attached thereto any material that better secures the cable 52 to the case 10. Thus, under the condition that the first half 12 and the second half 14 are placed together to form the case 10, the cable 52 can be secured to the case 10 by pulling the cable 52 into the cable securing section 31. The pressure from the straight edge of the second half 14 acts to push the cable 52 into the cable securing section 31 resulting in the cable 52 being secured to the case 10. To thereafter release the cable 52, the user simply lifts up on the cable 52 to release the gripping effect of the cable securing section 31 on the cable 52.

In addition to the cable securing section 31, the first half 12 also comprises a spool securing member, not pictured, that functions to restrict the spool 50 from rotating around the support member 60 when the spool 50 is not in use.

Further to FIG. 8, alternative embodiments of the case 10 include the first half 12 further comprising fasteners 16 positioned on front, back, and bottom sides of the first half 12. More specifically, the fasteners 16 on the first half 12 can be a combination of male members and female members of a fastening mechanism. As mentioned previously, in certain embodiments, the first half 12 can be structurally identical to the second half 14. Indeed, the first half 12 and the second half 14 can be two equal parts of the whole case 10. In other words, the first half 12 can be coupled to the identical second half 14 to form the case 10. In the instance where the first half 12 is identical to the second half 14, the male members of the fastener 16 can be positioned on the first half 12 and the corresponding female members of the fastener 16 can be positioned accordingly on the second half 14, such that when placed together, the male member of the fastener 16 mates with the female member of the fastener 16 to releasably secure the first half 12 to the second half 14 to form the case 10. In like manner, female members of the fastener 16 can be positioned on the first half 12 and the corresponding male members of the fastener 16 can be positioned accordingly on the second half 14, such that when placed together, the female member of the fastener 16 mates with the male member of the fastener 16 to releasably secure the first half 12 to the second half 14 to form the case 10. Moreover, each of the first half 12 and the second half 14 can have a combination of male and female members of the fastener 16 attached thereto, as shown in FIGS. 8-11.

Figure 9:
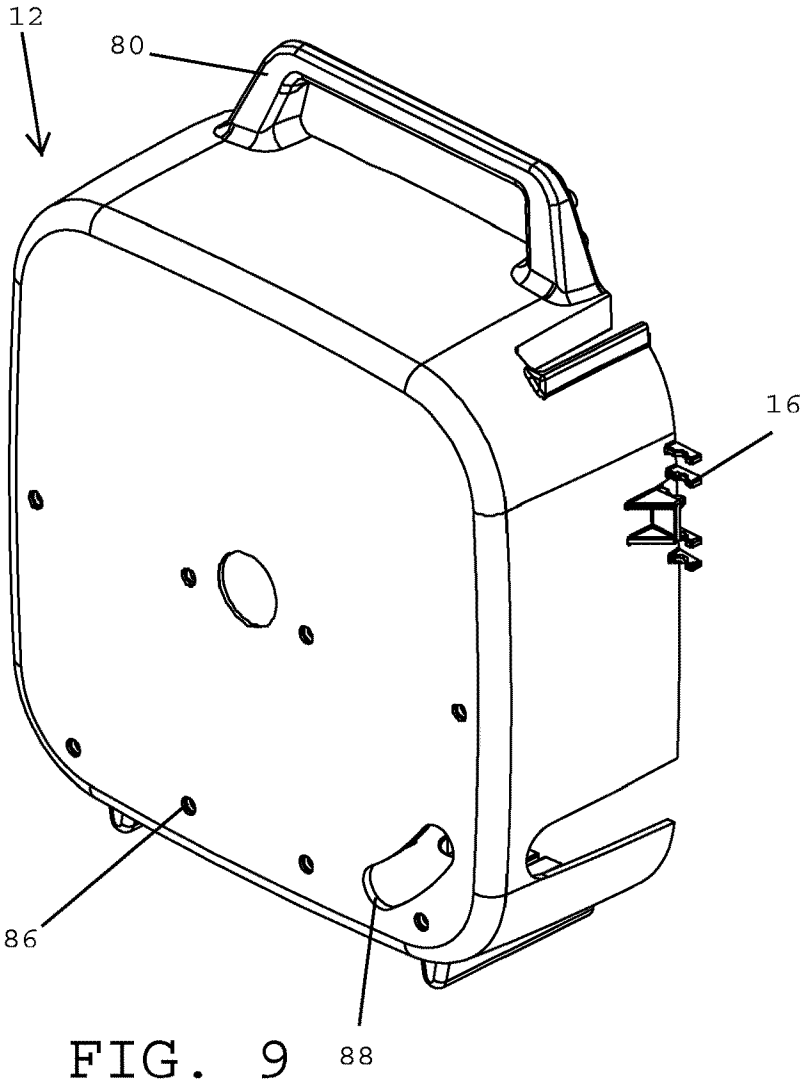
FIG. 9 is a rear exterior perspective view of the component of the embodiment of the cable carrying case shown in FIG. 8.

As mentioned above with respect to FIG. 4, and further disclosed in FIGS. 8 and 9, the case 10 includes the handle 80. In embodiments of the case 10 where one half of the handle 80 is part of the first half 12 and the other half of the handle 80 is part of the second half 14, the handle 80 further comprises receiving port 82 and peg 84. Each half of the handle 80 includes one of the receiving port 82 and one of the peg 84. Further, the receiving ports 82 of the one half of the handle 80 are configured to receive the pegs 84 of the other half of the handle 80, and vice versa, when the first half 12 is coupled to the second half 14 to form the case 10. With this configuration, the handle 80 is assured to be properly aligned when the case 10 is formed, thus creating a stronger handle 80 capable of performing its intended task, even under strenuous application.

As shown in FIGS. 8 and 9, the first and second halves 12 and 14 further comprise holes 86. Holes 86 penetrate completely through the surface 20 of the first halves 12 and 14 and are positioned at predetermined intervals with respect to one another on the surface 20. The positioning of the holes 86 correspond to mating openings 96 of an auxiliary member 90, each of which will be discussed in further detail below. Although shown to be circular in shape, the holes 86 may take any shape that corresponds to the shape of the mating openings 96 or allows the auxiliary member 90 to be secured to the case 10.

The halves 12 and 14 further comprise an aperture 88 in the surface 20 of the halves. The aperture 88 is configured to allow the user to access the spool of cable 50 within the case 10. Specifically, under the condition that the cable 52 has been paid out from the case 10 and a remaining unused portion of the cable 52 extends from the case 10, it is necessary to reel the cable 52 back into the case 10. Using the aperture 88, the user is able to reach into the case and operate the spool 52 to rotate the spool 50 within the case 10 to reel-in the unused portions of the cable 52. In other words, without needing to open the case 10, the user can rewind any unused cable 52 back onto the spool 50 by reaching through the aperture 88 to rotate the spool 50 in the appropriate direction to reel in the cable 52.

Figure 11:
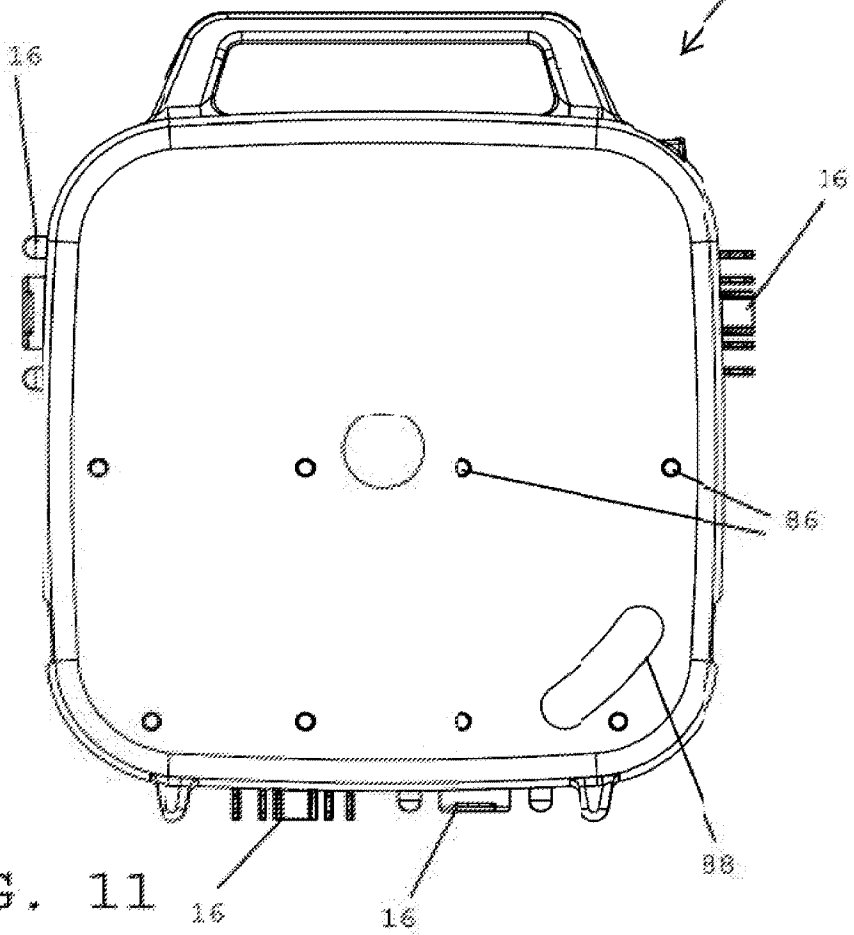
FIG. 11 is an exterior view of the embodiment of the cable carrying case shown in FIG. 10.
Figure 10:
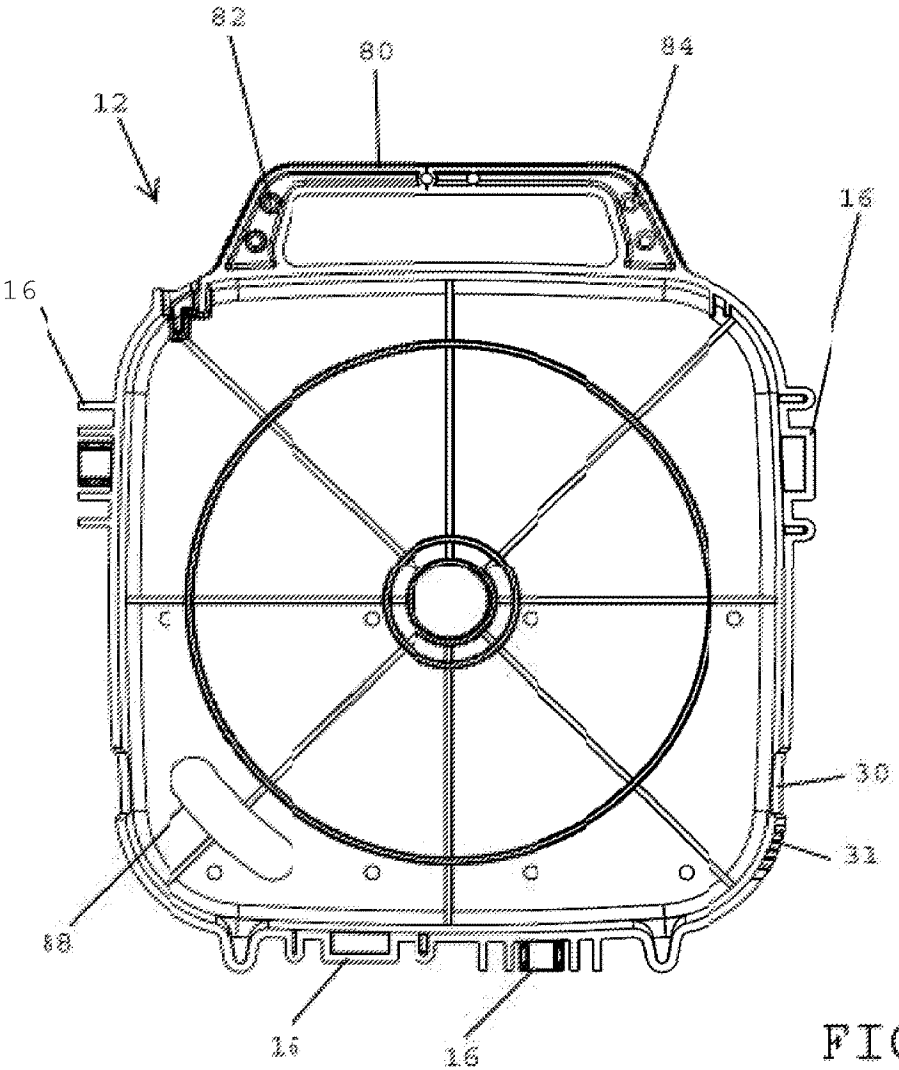
FIG. 10 is an interior view of an embodiment of the cable carrying case.

FIGS. 10 and 11 show an interior view of the first half 12 of the case 10 and an exterior view of the first half 12 of the case 10, respectively. As mentioned above, in an embodiment of the case 10, the first half 12 can be identical to the second half 14. Thus, the features of the first half 12 also represent and describe the features of the second half 14. Indeed, when placed side-by-side, the two halves 12 and 14 look indistinguishable from one another at any angle. However, when placed face-to-face, the structural configuration of the identical halves 12 and 14 allows the two independent halves 12 and 14 to form the case 10. For example, when it is desired to couple the respective halves 12 and 14 together to form the case 10, the fasteners 16 on the first half 12 mate with the fasteners on the second half 14 to secure each of the respective halves, 12 and 14, to one another to form the case 10. The fasteners 16 can any one of hinged fasteners, buckle fasteners, hook fasteners, or any other type of fastener, coupler, or securing mechanism, now known or later developed, that allows one portion of the fastener 16 positioned on one half of the case 10 to couple to the respective fastener 16 positioned on the other half of the case 10 to repeatedly secure the respective halves of the case 10 to one another, as needed, and release the respective halves from one another, as needed. In one embodiment, clips 16*a*, as shown in FIG. 15, can be releasably attached to fasteners 16 to facilitate the coupling of the fasteners 16 on the first half 12 to the fasteners 16 on the second half 14, as described above.

Figure 12:
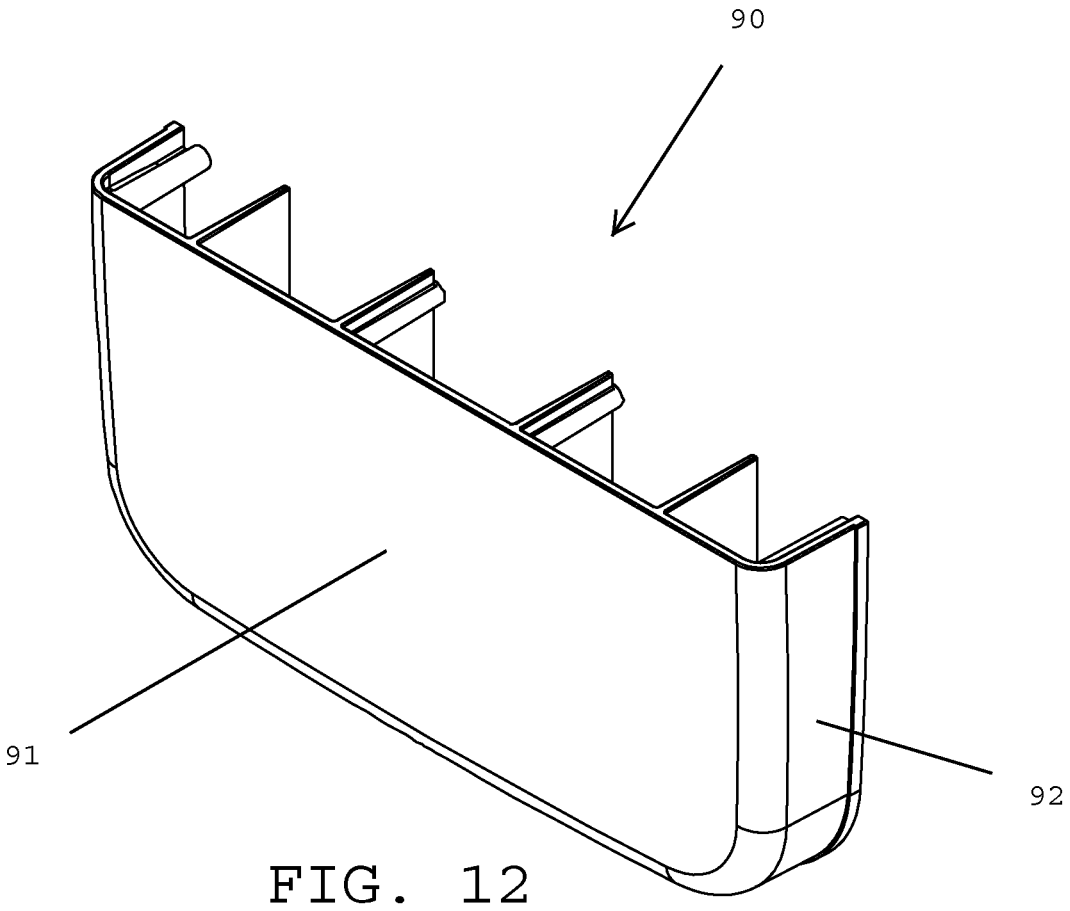
FIG. 12 is a front perspective view of a component of the cable carrying case.
Figure 13:
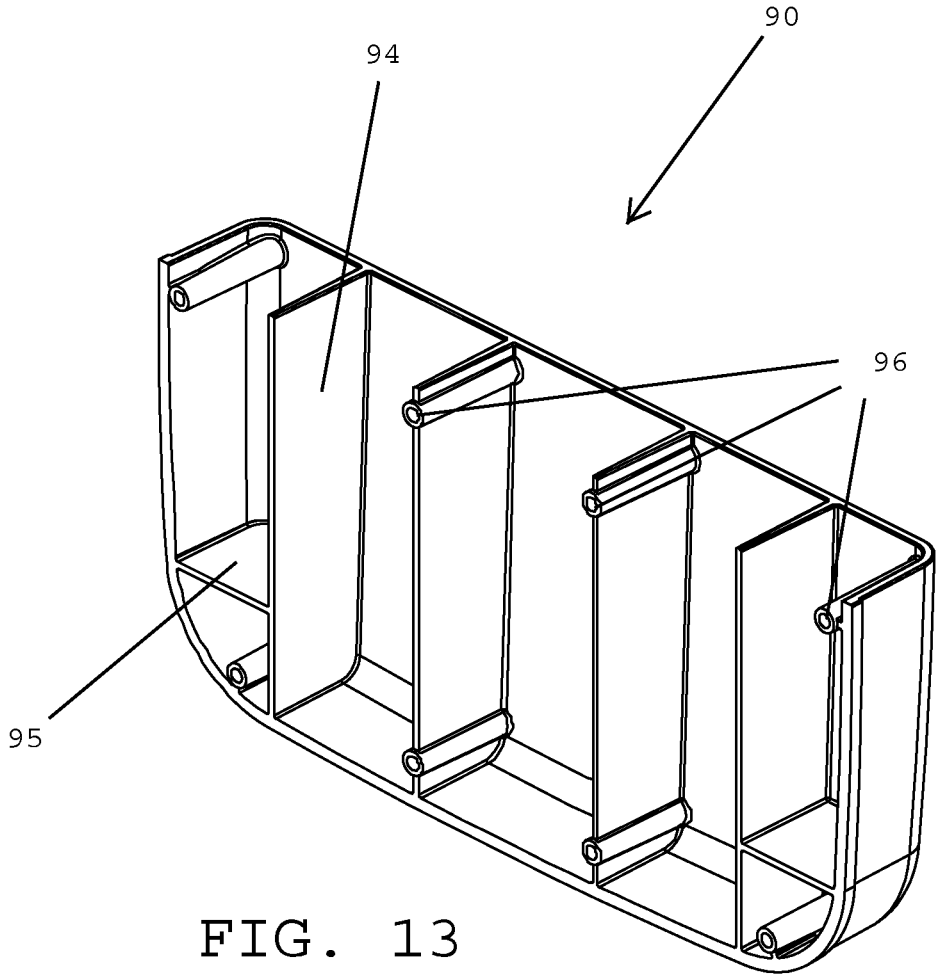
FIG. 13 is a rear perspective view of the component of the cable carrying case shown in FIG. 12.

As mentioned briefly above, case 10 may further comprise the auxiliary member 90, shown in FIG. 12, that can be releasably secured to the exterior face 20 of one of the first or second halves 12 and 14, or both, as desired. The auxiliary member 90 can be formed of one continuous piece of material and has a relatively flat outer exterior surface 91. The auxiliary member 90 further includes a lip 92 that protrudes substantially orthogonally from the outer exterior surface 91 on three of its four edges. The lip 92 functions to separate the outer exterior surface 91 from the surface 20 of the case 10. Specifically, when the auxiliary member 90 is attached to the case 10, an interior space between the outer exterior surface 91 and the surface 20 of the case 10 is created, the interior space thereby providing storage for tools or other accessories that the user may need during the performance of a task using the case 10. The interior of the auxiliary member 90, as shown in FIG. 13, further comprises ribs 94 that divide the interior space into distinct sections, some of which are wider or deeper than others to provide various storage options to the user. Ribs 94 protrude substantially perpendicularly from the surface 91 and run the length of the surface 91. One side of each of the ribs 94 remains exposed while the other side of each of the ribs 94 contacts and is secured to the lip 92 at the bottom of the auxiliary member 90. Horizontal securing ribs 95 may also be utilized to provide strength or integrity to the ribs 94 and/or auxiliary member 90. As shown in FIG. 13, securing ribs 95 are utilized to strengthen the lower corners of the auxiliary member 90, but may also be utilized in between any of the ribs 94 to add stability, or to provide additional variously-sized sections with the interior storage space, as desired.

Figure 14:
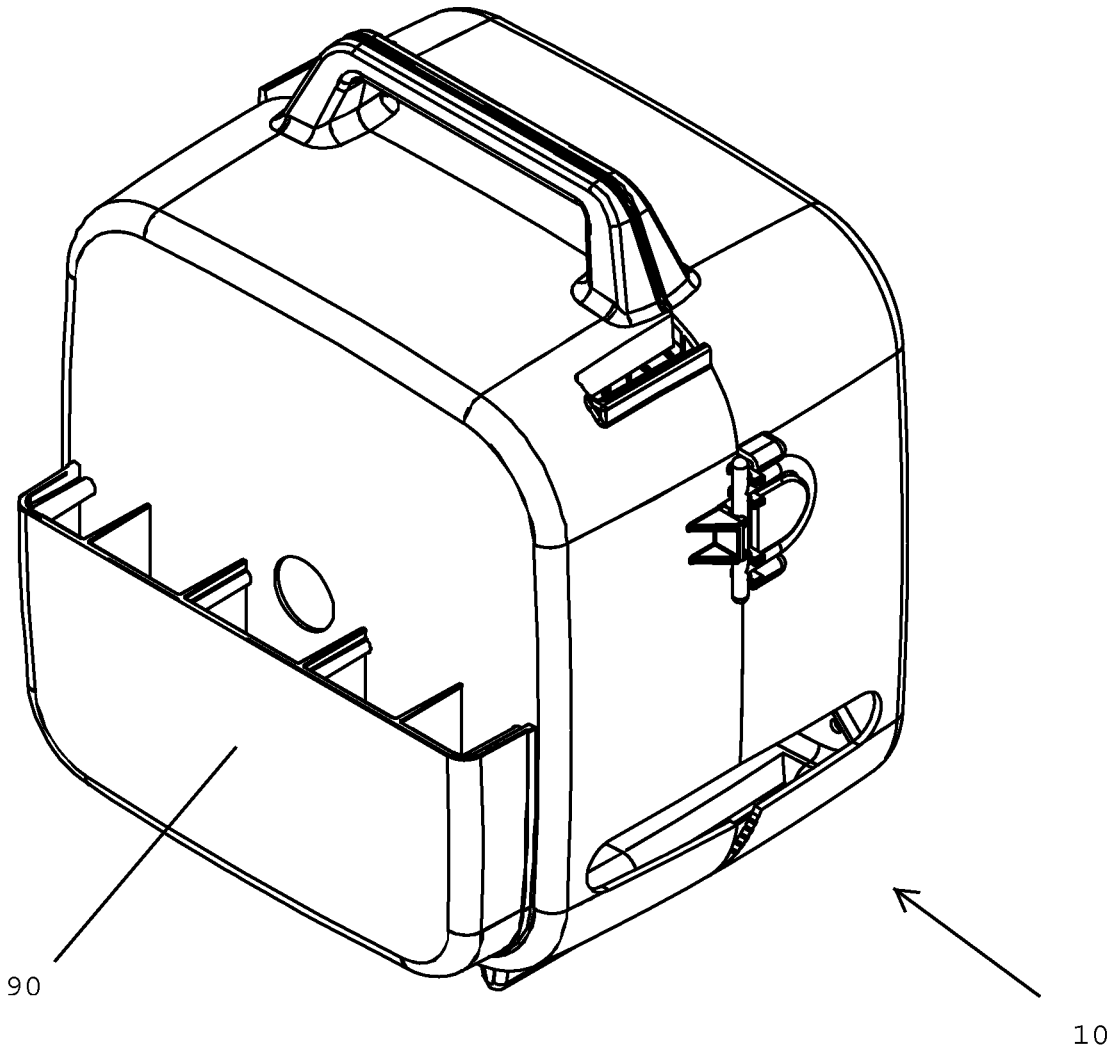
FIG. 14 is a front perspective view of an embodiment of the cable carrying case in a closed position.

Auxiliary member 90 further comprises the mating openings 96 that function to allow the auxiliary member 90 to fasten or couple to the case 10, as shown in FIG. 14. Mating openings 96 are positioned on the auxiliary member 90 to correspond to the positioning of the openings 86 on the exterior of the case 10. Fasteners, such as screws, or other coupling devices, not pictured, pass through the opening 86 and into the corresponding mating opening 96 to releasably couple the auxiliary member 90 to the case 10.

Figure 15:
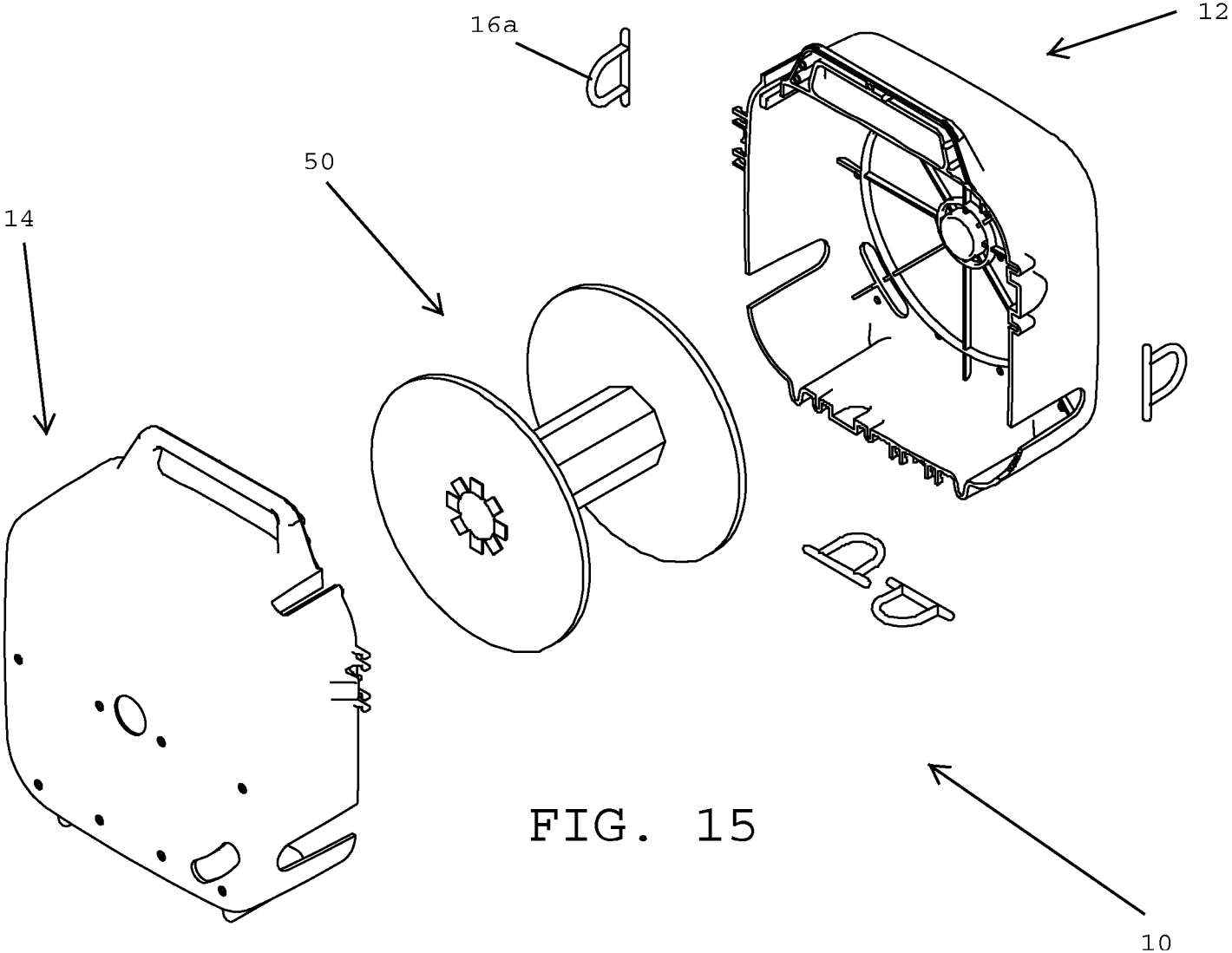
FIG. 15 is an exploded perspective view of an embodiment of the cable carrying case.
Figure 16:
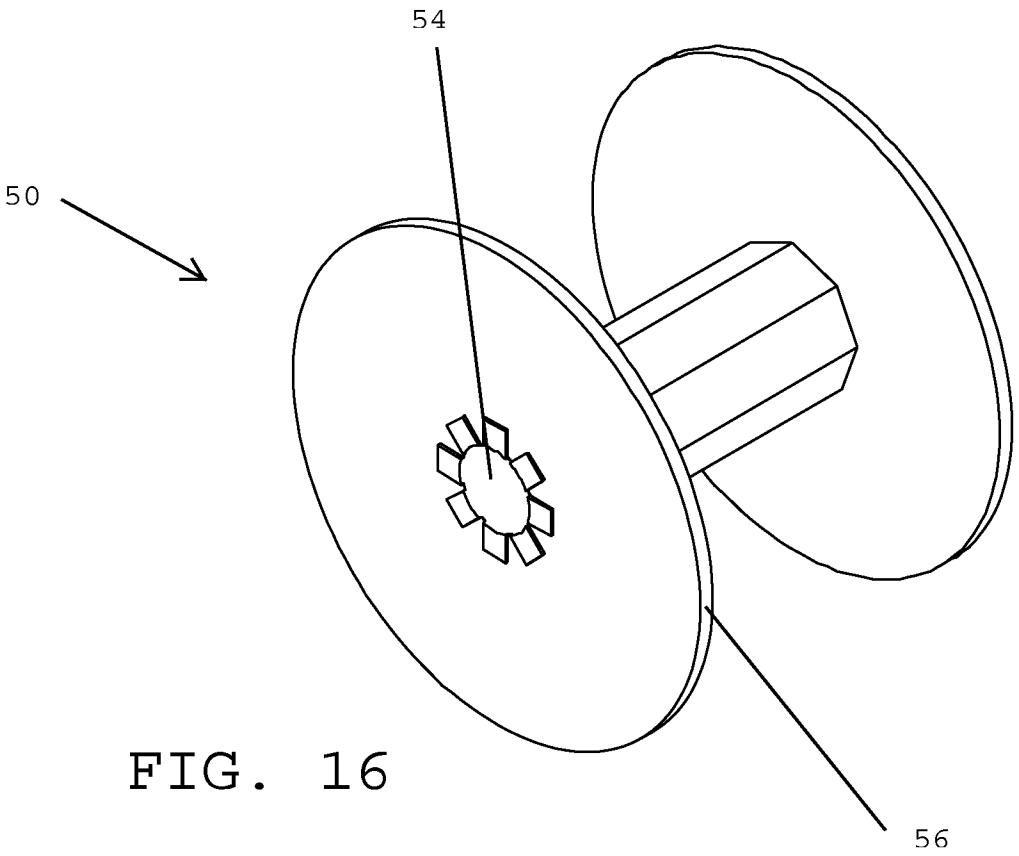
FIG. 16 is a perspective view of a component of the cable carrying case system.

As shown in FIG. 15, the cable carrying case 10 can also comprise a portion of a cable dispensing system. The system can comprise the case 10, as described in the forgoing embodiments, and a recyclable spool of cable 50. The system includes the user being able to insert the spool of cable 50 into the open case 10 and thereafter closing the case 10 to secure the spool 50 therein. Once secure, the spool 50 can be rotated to payout the cable 52 from the case 10. After the cable 52 is exhausted, the user can re-open the case 10, remove the empty spool 50 from the case 10, and place the empty spool 50 in the appropriate recycling container or facility. The spool 50 can be made of plastic recyclable material, paper recyclable material, cardboard recycling material, or any other recyclable material now known or later developed that allows the spool 50 to be recycled after the cable 52 on the spool 50 is exhausted, as shown in FIG. 16. After removing the exhausted spool 50, the user can insert a new spool 50 full of unused cable 52 into the case 10 to take the place of the previous spool 50 and recommence where the user left off.

In one embodiment, the case 10 is comprised of recyclable material, such as rigid recyclable plastic. Likewise, the cable spool 50 can be made of one or more recyclable materials, including cardboard, plastic, metal, paper, wood, as mentioned above. Also, the spool 50 generally has cable 52 placed thereon prior to placing the spool 50 in the case 10. Nevertheless, the cable 52 may also be wound on the spool 50 after the spool 50 has been placed within the case 10. Once the cable 52 is exhausted off the spool 50, the spool 50 can be removed from the case 10 and recycled. A new spool 50 is then placed within the case 10 and the user can get back to work.

In addition to that materials listed above, the case 10 may be comprised of any material suitable for protecting the inner contents of the case, specifically the reel of cable 50 and the cable 52 thereon. For example, the components defining the above-described case 10 may be formed of any of many different types of materials or combinations thereof that can readily be formed into shaped objects provided that the components selected are consistent with the intended operation of the case 10. The components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Figure 17:
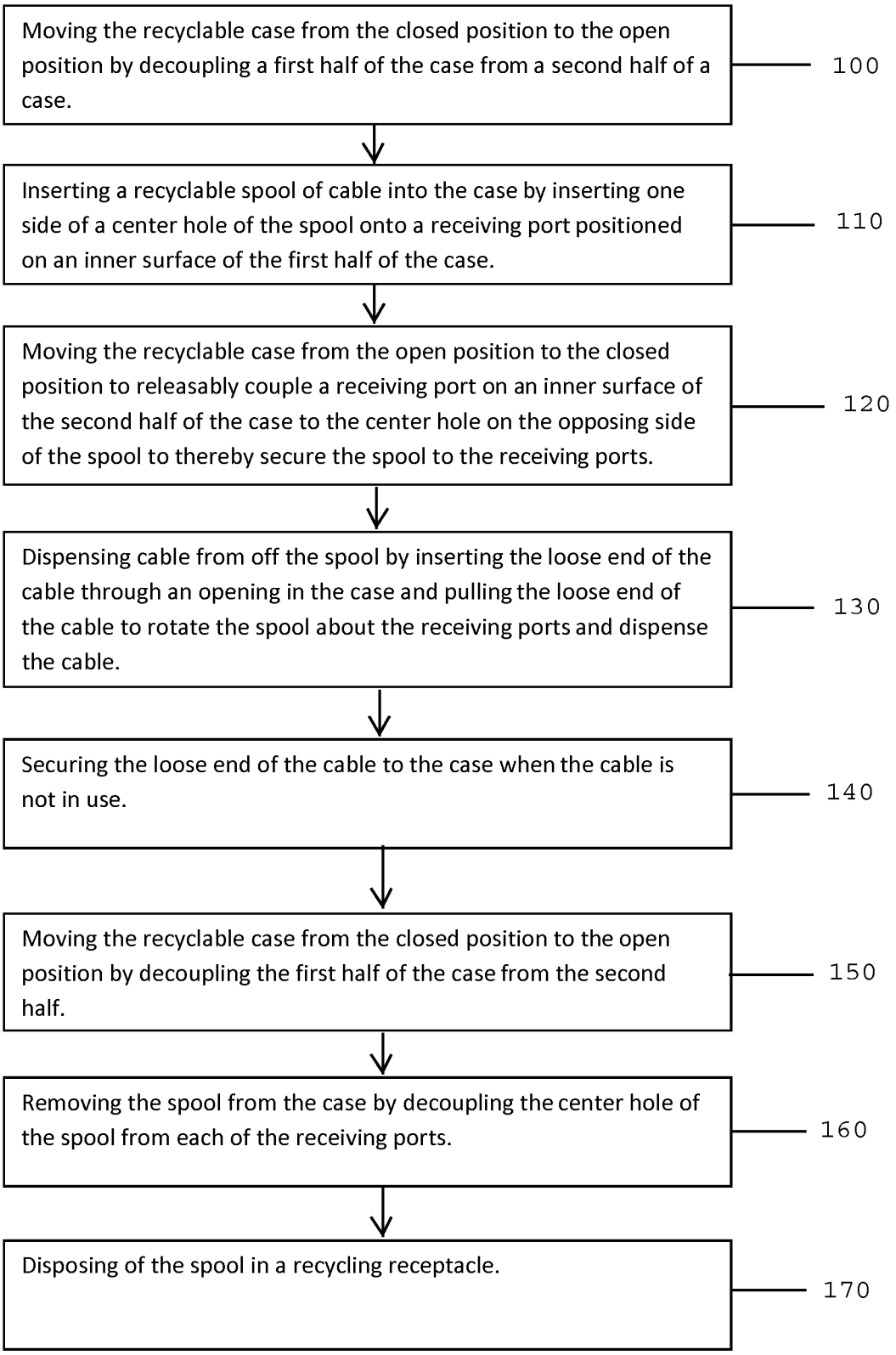
FIG. 17 is a diagram showing a method of use for the cable carrying case system.

Also, a method of using the cable carrying case is provided, as shown in FIG. 17. A user may first obtain the recyclable, rigid carrying case 10. As shown in step 100, the user can then move the case 10 from its closed position to its open position by releasing the fasteners 16 on one or more sides of the case 10. Once opened, the inside cavity of the case 10 is accessible and the interior features of the case are accessible, including the receiving ports 32. The user may obtain a recyclable spool 50 that has dispensable cable 52 wound thereon. As shown in step 110, the center portion 54 of the spool 50 can be inserted over the receiving port 32 on one of the halves 12 or 14, which releasably secures the spool 50 to the particular half 12 or 14. Thereafter, as shown in step 120, the receiving port 32 on the remaining half 12 or 14 may be placed into the center portion 54 of the opposing side of the spool 50 to releasably secure the spool to the remaining half 12 or 14. Thereafter, the two halves 12 and 14 can be fastened to one another with the spool 50 therebetween by operating the fasteners 16.

Once inserted into the case 10, the spool 50 can rotate about the receiving ports 32. Because the spool 50 is rotatable, the cable 52 wound thereon can be paid out off the spool 50 by pulling on the loose end of the cable 52, as shown in step 130. To do so, the loose end of the cable 52 is inserted through the first opening 30 in the front of the case or in the rear of the case, as desired by the user, to expose the loose end of the cable 52 to the outside of the case 10. The loose end of the cable 52 can be inserted through the first opening 30 either before the spool 50 is placed within the case 10 or after the spool 50 is placed within the case 10. The user can then payout the cable 52 from the spool 50 and the case 10 by pulling the desired length of the cable 52 from the case 10.

After the necessary length of cable has been dispensed from the case 10, the loose end of cable 52 can be secured to the case 10 to prevent the loose end of cable 52 from further paying out from the case 10, as shown in step 140. The user can insert the cable 52 into the cable securing section 31 that is structured to retain the loose end of cable 52 and prevent the cable 52 from unwantingly unwinding off the spool 50. Also, the user can insert a finger into the aperture 88 to rewind the extra length of cable 52 that has been unwound from the spool 50. The aperture allows the user to rotate the spool 50 in the direction to rewind the cable 52 back onto the spool 50. Thus, when the cable 52 has been rewound to the appropriate length, the loose end of the cable 52 can be placed in the cable securing section 31. Then, when the cable 52 is again needed, the user can remove the loose end of the cable 52 from the cable securing section 31 and payout the necessary length of cable 52 from the case 10.

After the cable 52 is exhausted from off the spool 50, the user can replace the spool 50 by moving the case 10 from its closed position to its open position by the method described above, as shown in step 150. Doing so decouples the receiving port 32 from one of the center portions 54. The spool 50 can be lifted off the remaining receiving port 32 to decouple the spool 50 from the remaining receiving port 32, as shown in step 160. Once decoupled from each receiving port 32, the exhausted spool 50 can be recycled, as shown in step 170.

Then, to replace the spool 50 within the case, the steps described above can be repeated. Thus, the cable case carrying system described above and method of use thereof allow a user to repeatedly carry, protect, and efficiently payout the cable 52 off a recyclable spool 50, often times made of cardboard, within a recyclable, rigid case 10.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the invention.

What is claimed is:

1. A cable carrying case comprising:

a first body portion having a first interior, the first body portion including a base surface and four secondary surfaces extending from the base surface;

a second body portion having a second interior, the second body portion including a base surface and four secondary surfaces extending from the base surface;

a support member configured to be coupled with the first body portion and the second body portion and to rotatingly receive a spool of cable;

wherein the four secondary surfaces of the first body portion include a first side surface, a second side surface opposite to the first side surface, a third side surface extending between the first side surface and the second side surface, and a fourth side surface opposite to the third side surface;

wherein the four secondary surfaces of the second body portion include a first side surface, a second side surface opposite to the first side surface, a third side surface extending between the first side surface and the second side surface, and a fourth side surface opposite to the third side surface;

wherein the base surface of the first body portion includes a first receiving port and the base surface of the second body portion includes a second receiving port;

wherein the support member includes a first end, a second end, and a support portion between the first end and the second end;

wherein the first end and the second end have a diameter that is less than a diameter of the support portion;

wherein the first receiving port is configured to receive the first end of the support member therein and the second receiving port is configured to receive the second end of support member therein;

wherein the first body portion and the second body portion are identical;

wherein the first side surface of the first body portion and side surface of the second body portion each include a first fastener portion;

wherein the second side surface of the first body portion and the second side surface of the second body portion each include a second fastener portion;

wherein the third side surface of the first bod portion and the third side surface of the second body portion each include a third fastener portion and a fourth fastener portion;

wherein the fourth side surface of the first body portion and the fourth side surface of the second body portion each include a handle portion;

wherein the first body portion and the second body portion are configured to be arranged in an open position, where at least one of the first interior and the second interior is accessible, and a closed position, where the first interior and the second interior are enclosed;

wherein, in the closed position, the first side surface of the first body portion is aligned with the second side surface of the second body portion and the second side surface of the first body portion is aligned with the first side surface of the second body portion;

wherein, in the closed position, the first fastener portion of the first side surface of the first body portion is configured to be coupled with the second fastener portion of the second side surface of the second body portion and the second fastener portion of the second side surface of the first body portion is configured to be coupled with the first fastener portion of the first side surface of the second body portion;

wherein in the closed position, the third fastener portion of the third side surface of the first body portion is configured to be coupled with the fourth fastener portion of the third side surface of the second body portion, and the fourth fastener portion of third side surface of the first body portion is configured to be coupled with the third fastener portion of the third side surface of the second body portion;

wherein the first body portion includes a first opening defined by one of the four secondary surfaces of the first body portion and the second body portion includes a second opening defined by one of the four secondary surfaces of the second body portion;

wherein the first opening and the second opening mate with one another to form a single opening;

wherein the base surface of the first body portion includes a first aperture and the base surface of the second body portion includes a second aperture;

wherein the first aperture and the second aperture are each configured to permit a user to access and operate a spool of cable in the case to rewind unused cable on the reel without opening the case;

wherein each of the first body portion and the second body portion includes an anti-friction member and reinforcing members that extend substantially orthogonally from the interior face of the respective base surface of the first and second body portions;

wherein the anti-friction members and the reinforcing members prevent the spool from contacting the interior face of the first and second body portions as the spool rotates within the case; and wherein the anti-friction members are configured to reduce the amount of friction between the cable spool and the case.

2. The cable carrying case of claim 1, wherein the first opening includes a cable securing section configured to fix a loose end of the coaxial cable to the case when the cable is not being paid out, wherein the cable securing section is smaller in size than the first opening and is configured to assist the first opening in securing the coaxial cable to the case, and wherein the cable securing section is configured to be large enough at an initial point to receive a width of the cable and small enough at an end point to grip the width of the cable.

3. The cable carrying cases of claim 1, wherein the first body portion and the second body portion are configured to be coupled to one another in a non-hinged arrangement.

4. A cable carrying case comprising:

a first body portion having a first interior, the first body portion including a base surface and four secondary surfaces extending from the base surface;

a second body portion configured to be removably coupled to the first body portion, the second body portion having a second interior and including a base surface and four secondary surfaces extending from the base surface;

a support member configured to be coupled with the first body portion and the second body portion and to rotatingly receive a spool of cable;

wherein the four secondary surfaces of the first body portion include a first side surface, a second side surface opposite to the first side surface, a third side surface, extending between the first side surface and the second side surface, and a fourth side surface opposite to the third side surface;

wherein the four secondary surfaces of the second body portion include a first side surface, a second side surface opposite to the first side surface, a third side surface extending between the first side surface and the second side surface, and a fourth side surface opposite to the third side surface;

wherein the base surface of the first body portion includes a first receiving port and the base surface of the second body portion includes a second receiving port;

wherein the support ember includes a first end, a second end, and a support portion between the first end and the second end;

wherein first end and the second end have a diameter that is less than a diameter of the support portion;

wherein the first receiving port is configured to receive the first end of the support member therein and the second receiving port is configured to receive the second end of the support member therein;

wherein the first side surface of the first body portion and the first side surface of the second body portion each include a first fastener portion;

wherein the second side surface of the first body portion and the second side surface of the second body portion each include a second fastener portion;

wherein the third side of the first body portion and the third side surface of the second body portion each include a third fastener portion and a fourth fastener portion;

wherein the first body portion and the second body portion are configured to be arranged in an open position where at least one of the first interior and the second interior is accessible, and a closed position, where the first interior and the second interior are enclosed;

wherein, in the closed position, the first side surface of the first body portion is aligned with the second side surface of the second body portion and the second side surface of the first body portion is aliened with the first side surface of the second body portion;

wherein, in the closed position, the first fastener portion of the first side surface of the first body portion is configured to be coupled with the second fastener portion of the second side surface of the second body portion and the second fastener portion of the second side surface of the first body portion is configured to be coupled with the first fastener portion of the first side surface of the second body portion;

wherein, in the closed position, the third fastener portion of the third side surface of the first body portion is configured to be coupled with the fourth fastener portion of the third surface of the second body portion, and the fourth fastener portion of the third side surface of the first body portion is configured to be coupled with the third fastener portion of the third side surface of the second body portion; and wherein the first body portion and the second body portion are identical.

5. The cable carrying case of claim 4, wherein the spool has a length that includes plural side-by-side windings of the cable and a pair of spaced apart outer flanges.

6. The cable carrying case of claim 4, wherein at least one of the first body portion and the second body portion is configured to be disposed upon a supporting surface.

7. The cable carrying case of claim 4, wherein the base surface of the first body portion includes a first aperture and the base surface of the second body portion includes a second aperture; and wherein the first aperture and the second aperture are each configured to permit a user to access and operate a spool of cable in the case to rewind unused cable on the reel without opening the case.

8. The cable carrying case of claim 4, wherein the first body portion includes a opening defined by one of the four secondary surfaces; and wherein the first opening includes a cable securing section configured to fix a loose end of the coaxial cable to the case when the cable is not being paid out.

9. The cable carrying case of claim 8, wherein the cable securing section is smaller in size than the first opening and is configured to assist the first opening in securing the coaxial cable to the case; and wherein the cable securing section is configured to be large enough at an initial point to receive a width of the cable and small enough at an end point to grip the width of the cable.

10. A cable carrying case comprising:

a first body portion having a first interior, the first body portion including a base surface and four secondary surface extending from the base surface;

a second body portion configured to be removably coupled to the first body portion, the second body portion having a second interior and including a base surface and four secondary surfaces extending from the base surface;

a support member configured to be coupled with the first body portion and the second body portion and to rotatingly receive a spool of cable;

wherein the four secondary surfaces of the first body portion include a first side surface, a second side surface opposite to the first side surface, a third side surface extending between the first side surface and the second side surface, and a fourth side surface opposite to the third side surface;

wherein the four secondary surfaces of the second body portion include a first side surface, a second side surface opposite to the first side surface, a third side surface extending between the first side surface and the second side surface, and a fourth side surface opposite to the third side surface;

wherein the base surface of the first body portion includes a first receiving port and the base surface of the second body portion includes a second receiving port;

wherein the support member includes a first end, a second end, and a support portion between the first end and the second end;

wherein the first end and the second end have a diameter that is less than a diameter of the support portion;

wherein the first receiving port is configured to receive the first end of the support member therein and the second receiving port is configured to receive the second end of the support member therein;

wherein the first side surface of the first body portion and the first side surface of the second body portion each include a first fastener portion;

wherein the second side surface of first body portion and the second side surface of the second body portion each include a second fastener portion;

wherein the body portion and the second body portion are configured to be arranged in an open position, where at least one of the first interior and the second interior is accessible, and a closed position, where the first interior and the second interior are enclosed;

wherein in the closed position, die first side surface of the first body portion is aligned with the second side surface of the second body portion and the second side surface of the first body portion is aligned with the first side surface of the second body portion;

wherein in the closed position, the first fastener portion of the first side surface of the first body portion is configured to be coupled with the second fastener portion of the second side surface of the second body portion and the second fastener portion of the second side surface of the first body portion is configured to be coupled with the fastener portion of the first side surface of the second body portion; and wherein the first body portion and the second body portion are identical.

11. The cable carrying case of claim 10, wherein the base surface of the first body portion includes a first aperture and the base surface of the second body portion includes a second aperture; and wherein the first aperture and the second aperture are each configured to permit a user to access and operate a spool of cable in the case to rewind unused cable on the reel without opening the case.

12. The cable carrying case of claim 10, wherein at least one of the first body portion and the second body portion is configured to be disposed upon a supporting surface.

13. The cable carrying case of claim 10, wherein the first body portion and the second body portion are configured to be arranged in an open position, where at least one of a first interior portion of the first body portion and a second interior portion of the second body portion is accessible, and a closed position, where the first interior portion and the second interior portion are enclosed.

14. The cable carrying case of claim 10, wherein the first body portion includes a first opening defined by one of the four secondary surfaces of the first body portion and the second body portion includes a second opening defined by one of the four secondary surfaces of the second body portion; and wherein the first opening and the second opening mate with one another to form a single opening.

15. The cable carrying case of claim 14, wherein the first opening includes a cable securing section configured to fix a loose end of the coaxial cable to the case when the cable is not being paid out.

16. The cable carrying case of claim 15, wherein the cable securing section is smaller in size than the first opening and is configured to assist the first opening in securing the coaxial cable to the case; and wherein the cable securing section is configured to be large enough at an initial point to receive a width of the cable and small enough at an end point to grip the width of the cable.

* * * * *